US008257107B2

(12) United States Patent
Tsuruta et al.

(10) Patent No.: US 8,257,107 B2
(45) Date of Patent: Sep. 4, 2012

(54) SHIELDING CONNECTOR APPARATUS

(75) Inventors: Satoshi Tsuruta, Yokkaichi (JP); Takeshi Ishibashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 140 days.

(21) Appl. No.: 12/861,032

(22) Filed: Aug. 23, 2010

(65) Prior Publication Data

US 2011/0053408 A1 Mar. 3, 2011

(30) Foreign Application Priority Data

Aug. 25, 2009 (JP) ..... 2009-194564

(51) Int. Cl.
*H01R 13/627* (2006.01)

(52) U.S. Cl. ..... 439/362; 439/559

(58) Field of Classification Search ..... 439/362, 439/364, 559, 28, 60, 939, 488
See application file for complete search history.

(56) References Cited

U.S. PATENT DOCUMENTS

| | | | | |
|---|---|---|---|---|
| 6,887,105 | B2 * | 5/2005 | Knighten et al. | 439/607.24 |
| 7,083,471 | B2 | 8/2006 | Hayashi | |
| 7,393,218 | B1 * | 7/2008 | Pavlovic et al. | 439/97 |
| 7,878,844 | B2 * | 2/2011 | Weidner | 439/533 |

* cited by examiner

*Primary Examiner* — Phuong Dinh
(74) *Attorney, Agent, or Firm* — Gerald E. Hespos; Michael J. Porco

(57) ABSTRACT

A shielding connector apparatus includes an equipment-side shielding connector (50) with an equipment-side shielding housing (51) and an electric wire-side shielding connector (20) with an electric wire-side shielding housing (21). A connector fit-on nut (65) is formed on the equipment-side shielding housing (51). The electric wire-side shielding housing (21) has a fit-on bolt (39) that is screwed into the connector fit-on nut (65) to fit both shielding connectors together. An equipment-side contact surface (64) is formed on the equipment-side shielding housing (51). An electric wire-side contact surface (38) is formed on the electric wire-side shielding housing (21).

7 Claims, 21 Drawing Sheets

SHIELDING CONNECTOR APPARATUS

BACKGROUND OF THE INVENTION

1. Field of the Invention

The invention relates to a shielding connector apparatus.

2. Description of the Related Art

U.S. Pat. No. 7,083,471 discloses a shielding connector mounted on a vehicle body to connect a plurality of shielding electric wires to each other.

This shielding connector apparatus disclosed in U.S. Pat. No. 7,083,471 has an equipment side-shielding case on which an equipment-side connector is mounted. The equipment side-shielding case extends to an electric wire side that includes an electric wire-side shielding housing with a hood that accommodates a shielding case and to which an electric wire-side connector is mounted.

The mounting portion of the equipment-side shielding case is accommodated inside the hood of the electric wire-side shielding housing. A lever is used to perform a fit-on operation to fit the connectors on each other at a fit-on finish position.

A slight gap is formed between the electric wire-side shielding housing and the equipment-side shielding case and generates a shield leakage. Therefore a bolt or the like is tightened after the connectors are fit together to bring the housings together and to form a fully closed shield. The above-described conventional shielding connector requires a large number of process steps to achieve full shielding and thus is complicated costly and inefficient to assemble.

The invention was made view of this situation. An object of the invention is to provide a shielding connector apparatus where connectors can reach a fit-on finish position merely by tightening a bolt and a fully closed shielding material can be formed by bringing shielding surfaces of the connectors into contact with each other.

SUMMARY OF THE INVENTION

The invention relates to a shielding connector apparatus having an equipment-side connector and an electric wire-side connector. The equipment-side connector is mounted on a connector-mounting part of a piece of equipment that has a shielding case. The electric wire-side connector has a shielding housing connected to the equipment-side connector by mounting the electric wire-side connector on the connector-mounting part. A connector fit-on nut is mounted on the connector-mounting part of the shielding case and a fit-on bolt is provided on the shielding housing of the electric wire-side connector. The fit-on bolt is screwed into the connector fit-on nut to fit the electric wire-side connector on the equipment-side connector. An equipment-side contact surface is formed on the connector-mounting part and intersects a fit-on direction of the connectors. The equipment-side contact surface defines an approximately loop shape surrounding the equipment-side connector. An electric wire-side contact surface is provided on the shielding housing of the electric wire-side connector and defines an approximately loop shape surrounding the electric wire-side connector. The electric wire-side contact surface is brought electrically into contact with the equipment-side contact surface when the connectors have reached a fit-on finish position by screwing the fit-on bolt into the connector fit-on nut. Thus it is possible to fit both connectors on each other and form the conductive shielded material.

The fit-on bolt preferably penetrates through the shielding housing of the electric wire-side connector. A removal prevention ring preferably is provided on a surface of the shielding housing at the fit-in side and prevents removal of the fit-on bolt. The fit-on bolt and the electric wire-side contact surface have a height dimension that exceeds a thickness dimension of the removal prevention ring. Accordingly, a fit-on bolt-tightening work can be performed without preparing a fit-on bolt separately when fitting the connectors together. Therefore, the number of work steps can be reduced.

An accommodation concavity preferably is formed on the equipment-side contact surface of the connector-mounting part and accommodates the removal prevention ring when the connectors have been fit together. Accordingly, the equipment-side contact surface and the electric wire-side contact surface contact each other over a large area and thus provide excellent shielding performance.

The equipment-side connector and the electric wire-side connector preferably have locking detection connectors that are fit together when the connectors have reached the fit-on finish position. One of the locking detection connectors has two fit-on detection terminal fittings and the other of the locking detection connectors has a shorting terminal that short-circuits the fit-on detection terminal fittings. Thus, even though the shielding housing is opaque, the fit-on detection terminal fittings of the locking detection connectors are short-circuited when both connectors are fit together. Thus, by checking an energized state of the locking detection connectors, it is possible to determine whether both connectors have been fit together properly.

The shielding house of the electric wire-side connector preferably has a body that covers the electric wire-side connector and a front-end hood that is disposed forward from the body in the fit-on direction the connectors. The hood increases in width in steps. A slit is formed at a front-end edge of the front-end hood and extends in the fit-on direction of the connectors. A fit-on detection projection is formed on the connector-mounting part of the shielding case and penetrates into the slit as the connection of the connectors progresses. A height of the fit-on detection projection is set so that a front end of the fit-on detection projection is coincident with an outer surface of a step at a boundary between the front-end hood and the body when the housings have reached the fit-on finish position. Accordingly the alignment of the fit-on detection projection relative to the step at the boundary between the front-end hood can be checked to determine whether both connectors have been fit together properly. More particularly, the connectors have reached the fit-on finish position and that the electric wire-side contact surface has been brought electrically into contact with the equipment-side contact surface when the fit-on detection projection and the outer surface of the step are continuous with each other and on the same plane. However, it is possible to determine that the connectors have not reached the fit-on finish position if the fit-on detection projection and the outer surface of the step are not on the same plane. Therefore, it is possible to determine easily that both connectors have been fit together incompletely and that the shielding connectors are ungrounded electrically.

A colored part having a color different from a color of the front-end hood preferably is formed at an inner end of the slit. The colored part is hidden by the front end of the fit-on detection projection when the connectors have reached the fit-on finish position. Accordingly, the colored part at the inner end of the slit gradually is hidden by the front end of the fit-on detection projection when both connectors are approaching the fit-on finish position. The colored part is hidden completely hidden by the fit-on detection projection when the connectors have reached the fit-on finish position. Thus it is possible to determine clearly whether both connectors have reached the fit-on finish position by checking whether the colored part is hidden by the fit-on detection projection.

A fit-on detection opening preferably is formed at a predetermined position of the shielding housing of the electric wire-side connector and marked portion is formed on the connector-mounting part of the shielding case in correspondence to the fit-on detection opening. The marked portion can be observed when the connectors have reached the fit-on finish position. Accordingly, the marked portion on the connector-mounting part gradually appears from below the fit-on detection opening in the electric wire-side shielding housing as the operation of fitting the shielding connectors on each other is being performed. The fit-on detection opening and the marked portion are coincident with each other when the connectors have reached the fit-on finish position. Therefore it is possible to determine whether the connectors have reached the fit-on finish position by observing the fit-on detection opening.

The invention enables an efficient operation of fitting shielding connectors together to form a good shield while reducing the number of work steps and increasing work efficiency.

DETAILED DESCRIPTION OF THE PREFERRED EMBODIMENTS

Figure 1:
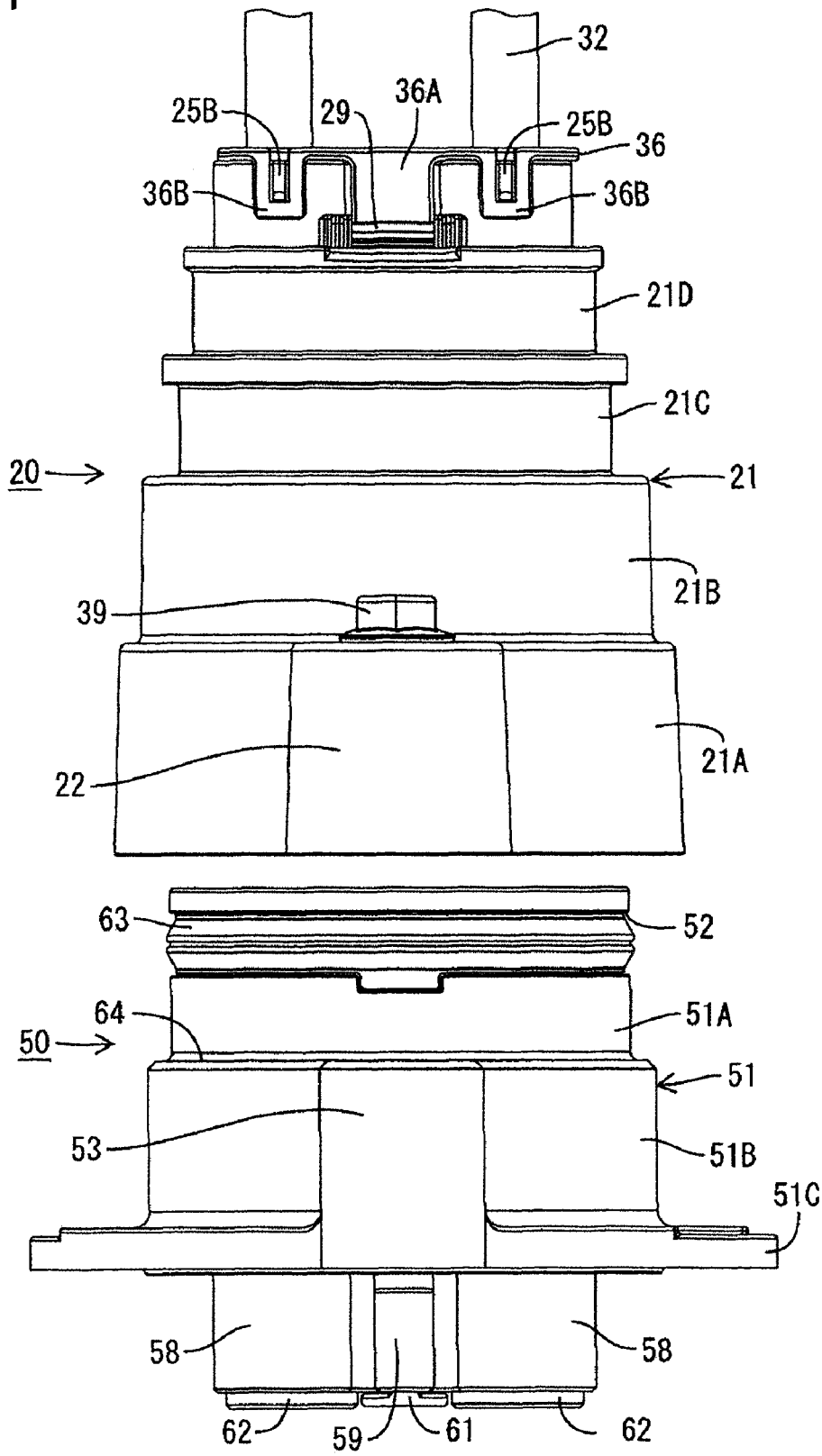
FIG. 1 is a front view showing a state before male and female shielding connectors of a first embodiment of the invention are fit together.
Figure 2:
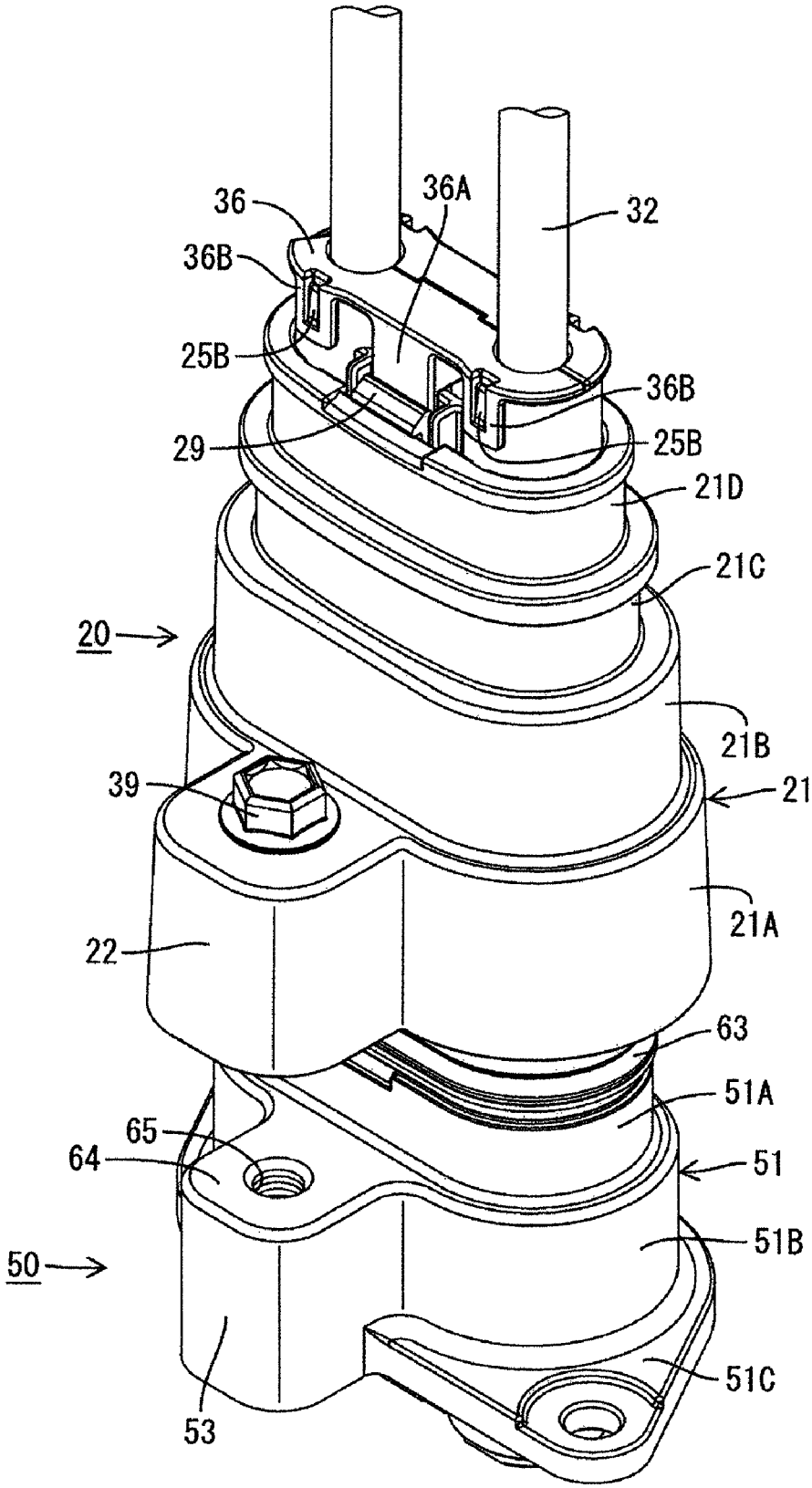
FIG. 2 is a perspective view showing the state before male and female shielding connectors of the first embodiment 1 are fit together.
Figure 3:
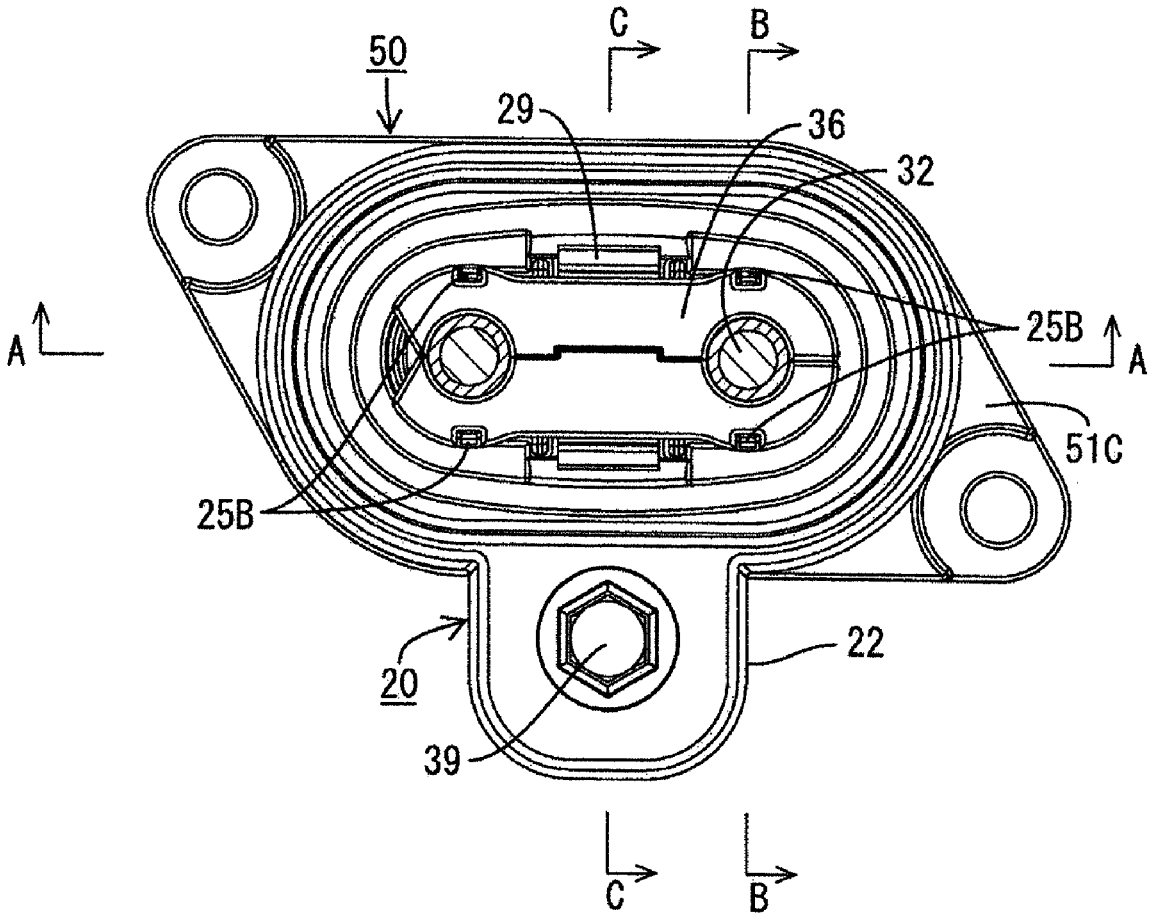
FIG. 3 is an electric wire-side rear plan view showing the state before male and female shielding connectors are fit together.

A shielding connector in accordance with a first embodiment of the invention has an electric wire-side shielding connector 20 and an equipment-side shielding connector 50. The electric wire-side shielding connector 20 has a longitudinally extending substantially elliptic tubular peripheral wall that becomes gradually smaller toward the rear in stages as explained herein. The equipment-side shielding connector 50 is mounted on a shielding case of equipment and can be inserted into the electric wire-side shielding connector 20. The equipment-side shielding connector 50 has a longitudinally extending substantially elliptic tubular peripheral wall that becomes gradually larger toward the rear in stages as explained herein.

As shown in FIGS. 1 through 7, the electric wire-side shielding connector 20 has an electric wire-side housing 23 mounted inside an elliptic tubular electric wire-side shielding housing 21 that is longitudinally hollow and open at its front and rear ends.

Inner and peripheral walls of the electric wire-side shielding housing 21 are stepped. More particularly, the peripheral wall of the electric wire-side shielding housing 21 has four stepped peripheral wall sections 21A, 21B, 21C, and 21D formed rearward from an open front edge thereof. Thus, the peripheral wall of the electric wire-side shielding housing 21 is stepped almost uniformly at three positions. Three stepped inner peripheral wall sections 21E, 21F, and 21G are formed on the inner peripheral wall of the electric wire-side shielding housing 21 rearward from the front open edge thereof. Thus, a step is formed at a position having a length of ¼ of the entire length of the inner peripheral wall of the electric wire-side shielding housing 21 and at a central position of the inner peripheral wall. A forwardly facing step 21H is formed between the electric wire-side inner peripheral walls 21F and 21G.

The electric wire-side housing 23 is longitudinally hollow and has a flat electric wire-side box 26 sandwiched between two electric wire-side tubes 25. An electric wire-side flange 24 is formed near the longitudinal center of the electric wire-side housing 23. An elastically deformable engaging claw 29 is formed on the electric wire-side box 26 at a position a little forward from a longitudinal rear end thereof.

The electric wire-side housing 23 is inserted into the electric wire-side shielding housing 21 from an edge of a front opening thereof until the electric wire-side flange 24 of the electric wire-side housing 23 contacts the step 21H of the electric wire-side shielding housing 21 with the peripheral wall of the electric wire-side housing 23 sliding in contact with the electric wire-side inner peripheral wall 21G of the electric wire-side shielding housing 21. The engaging claw 29 on the electric wire-side housing 23 penetrates through the electric wire-side shielding housing 21 when the electric wire-side flange 24 of the electric wire-side housing 23 contacts the step 21H. The engaging claw 29 elastically deforms and is locked to the rear end surface of the electric wire-side shielding housing 21. Thus the electric wire-side housing 23 is combined with the electric wire-side shielding housing 21.

A base 23B is formed forward of the electric wire-side flange 24 of the electric wire-side housing 23 and in the range from the electric wire-side flange 24 to the center between the electric wire-side flange 24 and the front end of the electric wire-side housing 23. The base 23B includes the electric wire-side tube 25 and the electric wire-side box 26 integral therewith. An electric wire-side groove 30 is formed on the base 23B and an elliptic first rubber ring 31 is mounted entirely around a peripheral wall of the electric wire-side groove 30.

Two front tubes 25A are formed at positions forward from the base 23B and are narrower than the cylindrical part that extends rearward. A narrow front box 26A is formed between the front tubes 25A. A connector slit 23A is disposed between the front tube 25A and the front box 26A and extends toward the electric wire-side flange 24.

About half of a front end surface of the front tube 25A into which an equipment-side terminal fitting is inserted is closed from a periphery of the front end surface of the front tube 25A toward the center of the circle. A wall surface of the front tube 25A at the side of the electric wire-side box part 26 is cut out from the front end surface to the electric wire-side flange 24. Therefore the front end surface of the front tube 25A is formed as a circular arc-shaped open edge.

A locking detection terminal accommodation part 27 is open at a central portion of a front end surface of the front box 26A. A plate-shaped fit-on detection terminal fitting 28 is mounted on the locking detection terminal accommodation part 27 and has two needle-like projections 28A. The fit-on detection terminal fitting 28 is a counterpart of a pair of locking detection connectors. The fit-on detection terminal fitting 28 is inserted into a shorting terminal 60 corresponding thereto so that the needle-like projections 28A of the fit-on detection terminal fitting 28 are short-circuited to form a conductive state. An energized state can be monitored to check a terminal fitting-connected state even if the terminal fitting-connected state cannot be seen.

Retainer stoppers 25B are formed at four positions of a longitudinally rear peripheral wall surface of the electric wire-side tube 25 of the electric wire-side housing 23.

An accommodation hole 34 and a lance 35 are formed inside the electric wire-side tube 25 of the electric wire-side housing 23. The accommodation hole 34 accommodates an electric wire-side terminal fitting 33 to which an electric wire 32 is crimped.

The electric wire-side terminal fitting 33 is cylindrical at a front end thereof end and has a connection part 33A on an inner wall of a central portion thereof and an engaging part 33B disposed rearward from the connection part 33A. The lance 35 engages the engaging part 33B to prevent the electric wire-side terminal fitting 33 from being removed from the electric wire-side housing 23.

A back retainer 36 is mounted on the rear end surface of the electric wire-side housing 23 to prevent removal of the electric wire 32. The back retainer 36 has a crosslinking part 36A with two longitudinally disposed plate-shaped projections to sandwich two electric wires 32 therebetween and to fix the interval between the two electric wires. The back retainer 36 also has engaging frames 36B at four positions corresponding to the positions of the retainer stoppers 25B.

The two electric wires 32 are sandwiched fixedly between the crosslinking part 36A and then the crosslinking part 36A is inserted between the electric wire-side box 26 of the electric wire-side housing 23. Thus, the engaging claw 29 of the electric wire-side box 26 engages the engaging frame 36B with the retainer stopper 25B. At this time, the crosslinking part 36A prevents dislocation of the back retainer 36 and removal of the engaging claw 29.

A ring-shaped rubber stopper 37 is mounted on the electric wire 32 at a position forward from an end surface of the back retainer 36 to waterproof the gap between the inner wall of the electric wire-side housing 23 and the electric wires 32.

As shown in FIGS. 1 through 6 and 8, the equipment-side shielding connector 50 has an equipment-side shielding housing 51 on which a fixing flange 51C is formed. The fixing flange 51C is used to mount the open edge formed disposed on a rear end surface of the equipment-side shielding connector 50 on the equipment.

Two-stepped peripheral walls 51A and 51B are formed rearward from a front open edge of a peripheral wall of the equipment-side shielding housing 51. Thus one step is formed on the peripheral wall of the equipment-side shielding housing 51. An equipment-side ring groove 52 is formed on the equipment-side peripheral wall 51A and receives an elliptic second rubber ring 63.

An elliptically concave flange accommodation part 55 is formed slightly forward of a rear open edge of the equipment-side shielding housing 51. An engaging projection 55A is formed on the flange accommodation part 55 at the center of a longitudinal portion thereof.

An elliptic rubber packing 57 is mounted on the flange accommodation part 55 of the equipment-side shielding housing 51 to prevent water from penetrating into the equipment-side shielding housing 51 from the rear. An equipment-side housing 54 is inserted into the rubber packing 57 from the rear until an equipment-side flange 56 formed at a longitudinally central portion of the equipment-side housing 54 contacts the rubber packing 57.

A press-fit hole 56A is formed at a central part of a longitudinal portion of the equipment-side flange 56 at a position corresponding to the engaging projection 55A of the flange accommodation part 55. The engaging projection 55A of the flange accommodation part 55 is press fit into the press-fit hole 56A to combine the equipment-side housing 54 with the equipment-side shielding housing 51.

A flat equipment-side box 59 is sandwiched between two equipment-side tubes 58 of the equipment-side housing 54. The front tubes 25A of the electric wire-side housing 23 are accommodated inside front parts of the respective equipment-side tubes 58 when both shielding connectors are fit together. Therefore, the electric wire-side part 26 of the electric wire-side housing 23 is accommodated inside a front part of the equipment-side box 59 at a front portion thereof.

A conic equipment-side terminal fitting 62 is molded onto a rear inner wall surface of the equipment-side tube 58. A projected terminal 62A and a connection head 62B are formed on the equipment-side terminal fitting 62. The connection head 62B is formed by molding the front end of the projected terminal 62A with synthetic resin.

Two rib plates 54A project between the equipment-side tube 58 and the equipment-side box 59 and extend straight toward the front at a position that corresponds to the connector slit 23A of the electric wire-side housing 23.

The front tube 25A, the electric wire-side box 26, and the rib plates 54A are inserted respectively into the equipment-side tube 58, the equipment-side box 59, and the connector slit 23A when fitting the electric wire-side housing 23 on the equipment-side connector housing 54.

The shorting terminal 60 corresponding to the fit-on detection terminal fitting 28 is inserted into a rear open edge of the equipment-side box 59 of the equipment-side housing 54. The terminal retainer 61 is inserted into the rear open edge of the equipment-side box 59 from the rear of the shorting terminal 60 to prevent removal of the shorting terminal 60. Two insertion openings are formed on a front end surface of the shorting terminal 60 for receiving the fit-on detection terminal fitting 28.

The terminal retainer 61 defines a box-shape with engaging projections 61A on both side surfaces and an opening 61B on a rear end surface. The engaging projections 61A penetrate into an inner wall of the equipment-side box 59 of the equipment-side housing 54 from the open rear end and then is engaged by an engaging step 59A formed on the inner wall of the equipment-side box 59. Thus, the terminal retainer 61 is prevented from being removed from the equipment-side housing 54.

A projection 53 projects from a surface of a longitudinal portion of the equipment-side peripheral wall 51B of the equipment-side shielding housing 51 and extends from the rear end of the equipment-side shielding housing 51 to the boundary between the equipment-side peripheral walls 51A and 51B. A connector fit-on nut 65 is provided on a front end surface of the projection 53.

A box-shaped front hood 22 is formed on one surface of the longitudinal portion of the electric wire-side peripheral wall 21A of the electric wire-side shielding housing 21. The front hood 22 projects from the electric wire-side peripheral wall 21A and extends from the front open edge of the electric wire-side shielding housing 21 to the boundary between the electric wire-side peripheral wall 21A and the second-step electric wire-side peripheral wall 21B. A fit-on bolt 39 is mounted on the front hood 22 and is screwed into the connector fit-on nut 65 of the projected part 53 to fit the shielding connectors together.

An E-ring 40 holds the fit-on bolt 39 on the front hood 22 with the fit-on bolt 39 penetrating through the front hood 22 from the rear. The E-ring 40 engages the fit-on bolt 39 at a mounting groove 42 on an inner surface of the front hood 22 at the fit-on side. The mounting groove 42 has a depth a little longer than the thickness of the E-ring 40.

The electric wire-side shielding housing 21 has an electric wire-side contact surface 38 between the electric wire-side inner peripheral wall 21E of the electric wire-side shielding housing 21 and the electric wire-side inner peripheral wall 21F thereof. The electric wire-side contact surface 38 surrounds the electric wire-side housing 23 in the shape of a loop and is integral with the inner surface of the front hood 22 at its fit-on side of the electric wire-side shielding housing 21.

The equipment-side shielding housing 51 has an equipment-side contact surface 64 between the equipment-side peripheral wall 51A of the electric wire-side shielding housing 21 and the equipment-side peripheral wall 51B thereof. The equipment-side contact surface 64 surrounds the equipment-side connector housing 54 in the shape of a loop. The equipment-side contact surface 64 is integral with the front end surface of the projection 53 of the equipment-side shielding housing 51 and has a construction corresponding to the electric wire-side contact surface 38 of the electric wire-side shielding housing 21.

Figure 4:
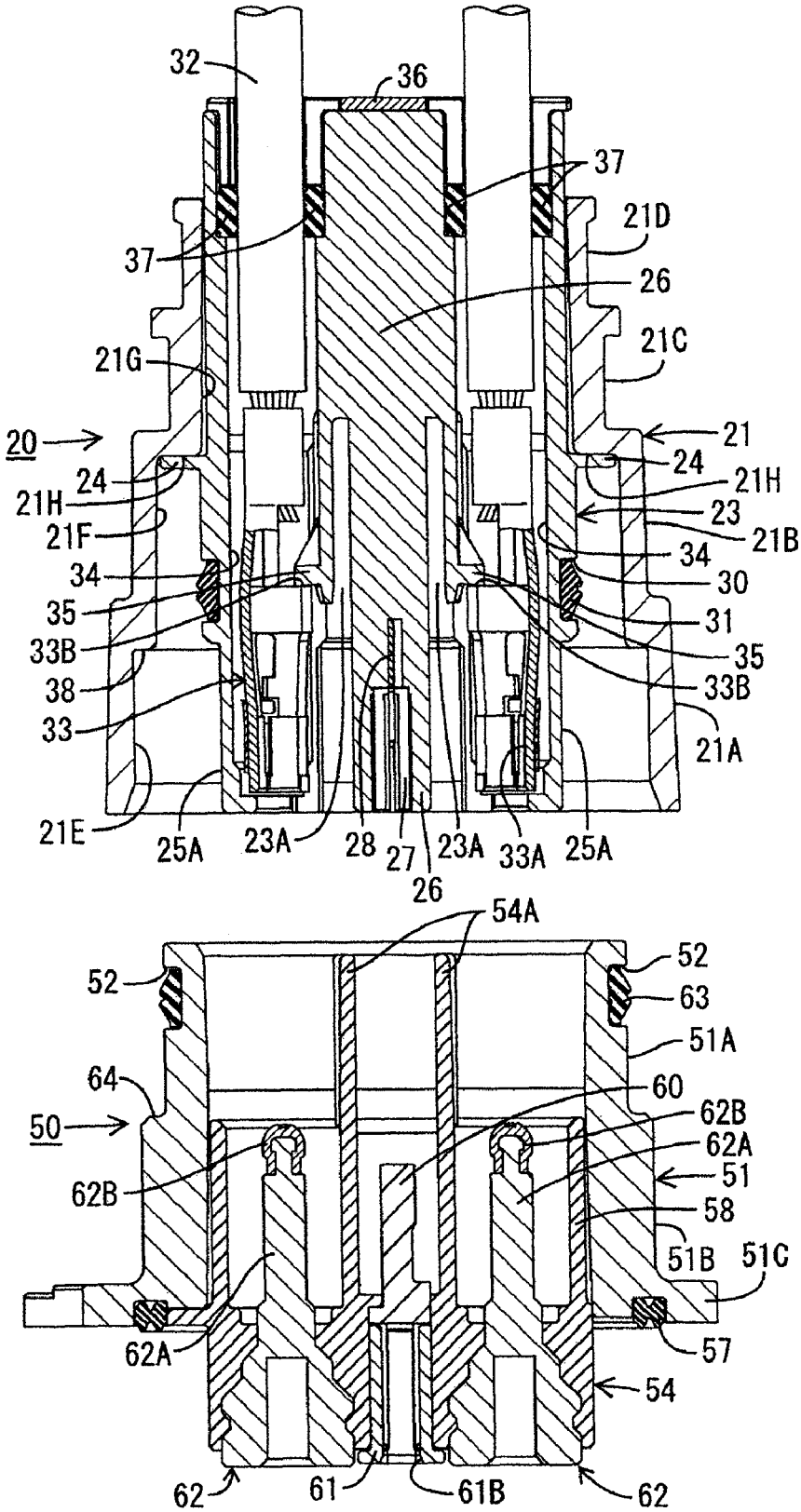
FIG. 4 is a sectional view taken along a line A-A of FIG. 3.
Figure 5:
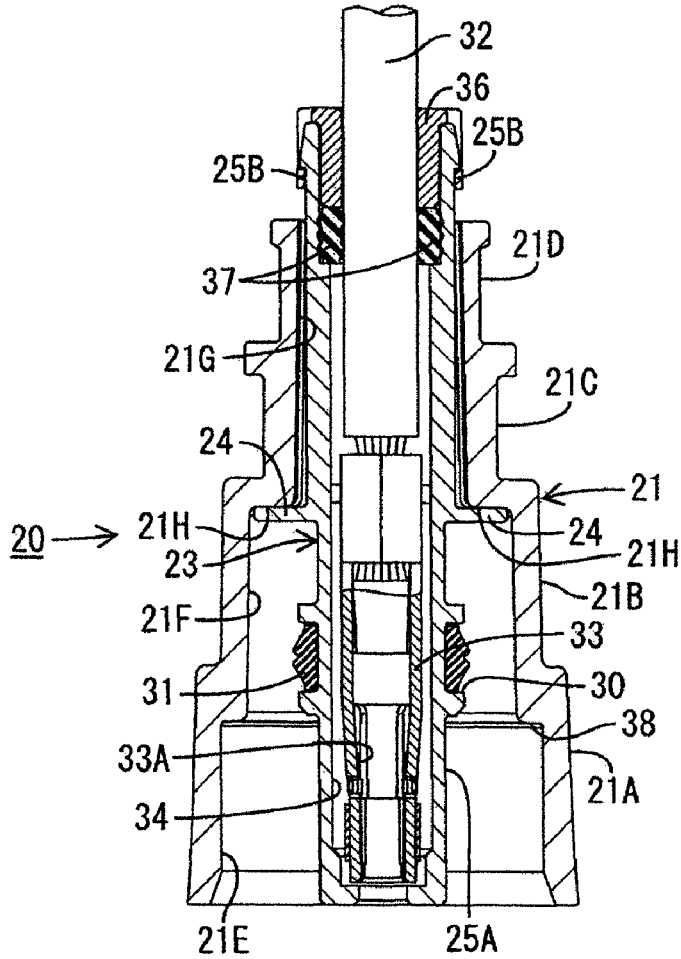
FIG. 5 is a sectional view taken along a line B-B of FIG. 3
Figure 5:
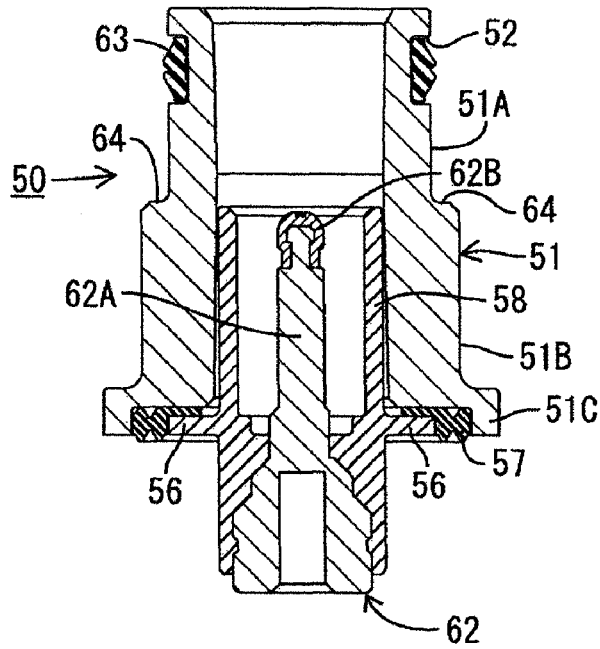
Figure 6:
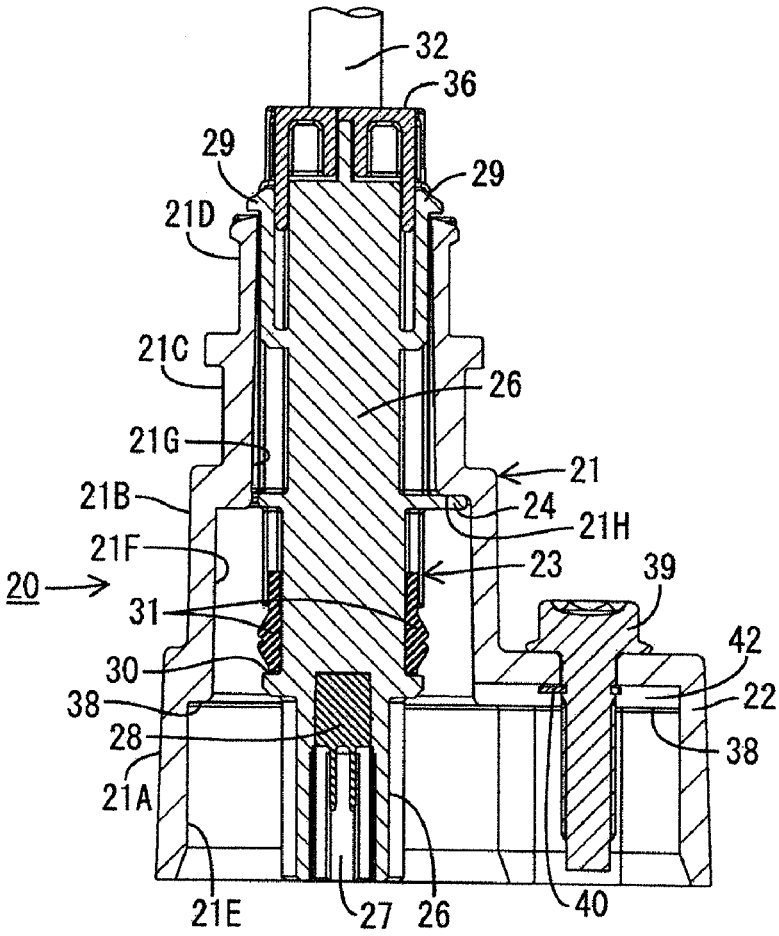
FIG. 6 is a sectional view taken along a line C-C of FIG. 3.
Figure 6:
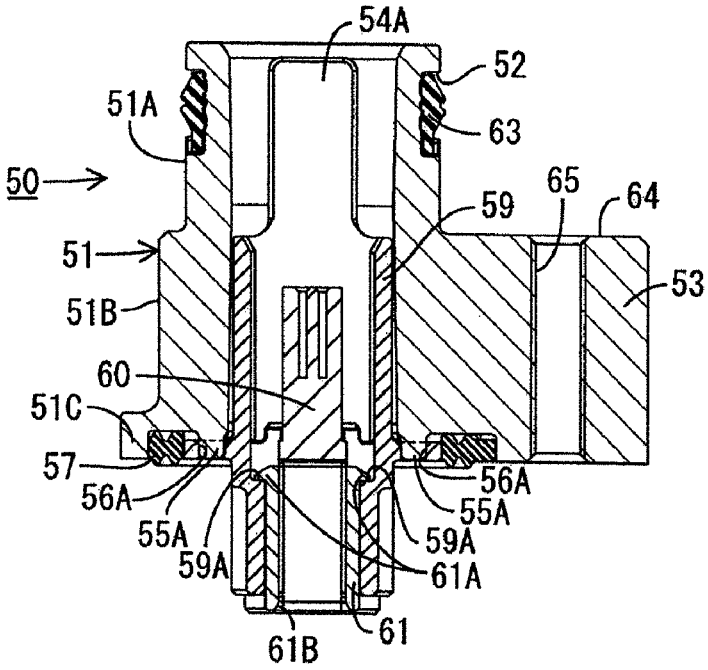
Figure 7:
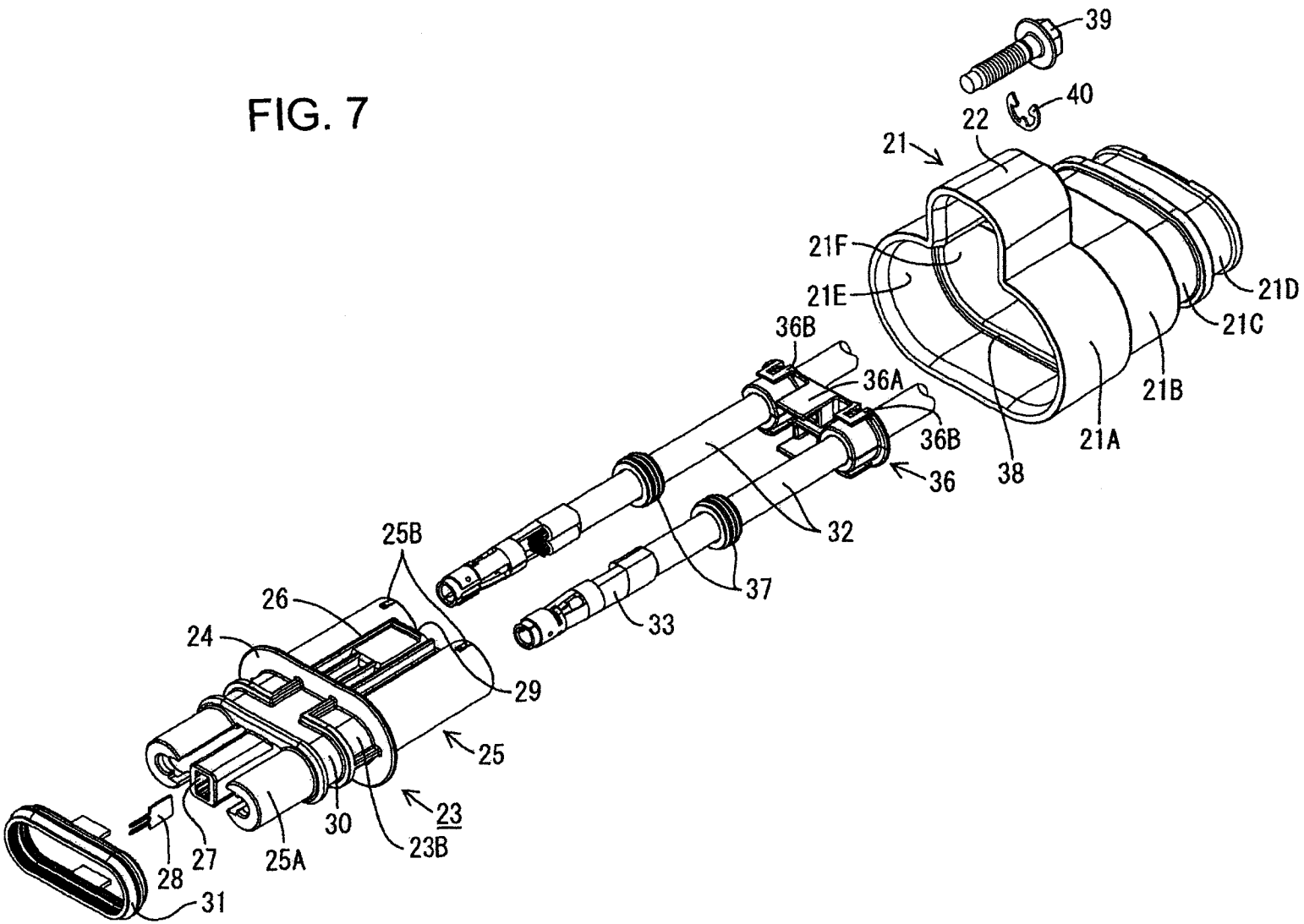
FIG. 7 is a perspective view showing a state before an electric wire-side shielding connector is assembled.
Figure 8:
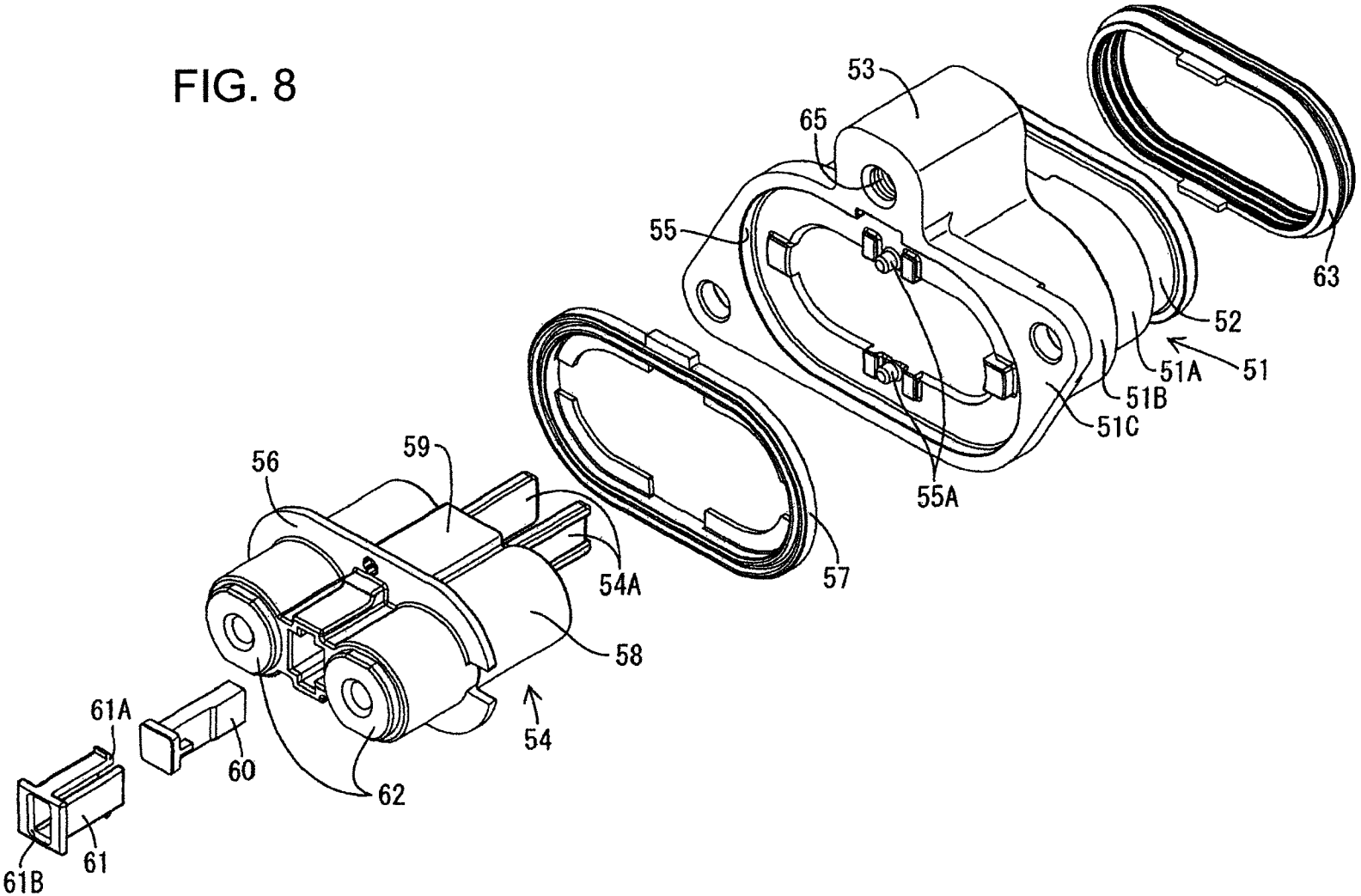
FIG. 8 is a perspective view showing a state before an equipment-side shielding connector is assembled.
Figure 9:
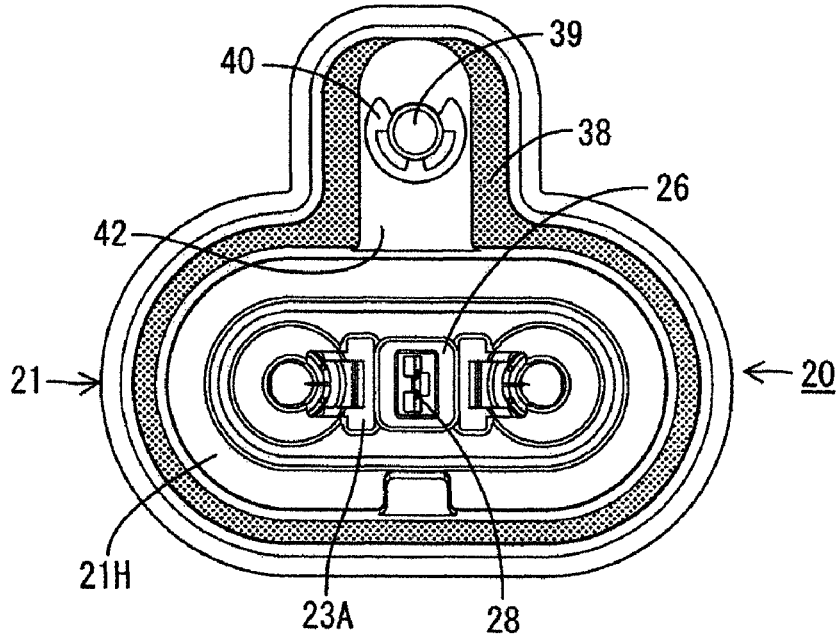
FIG. 9 is a front plan view showing the electric wire-side shielding connector.
Figure 10:
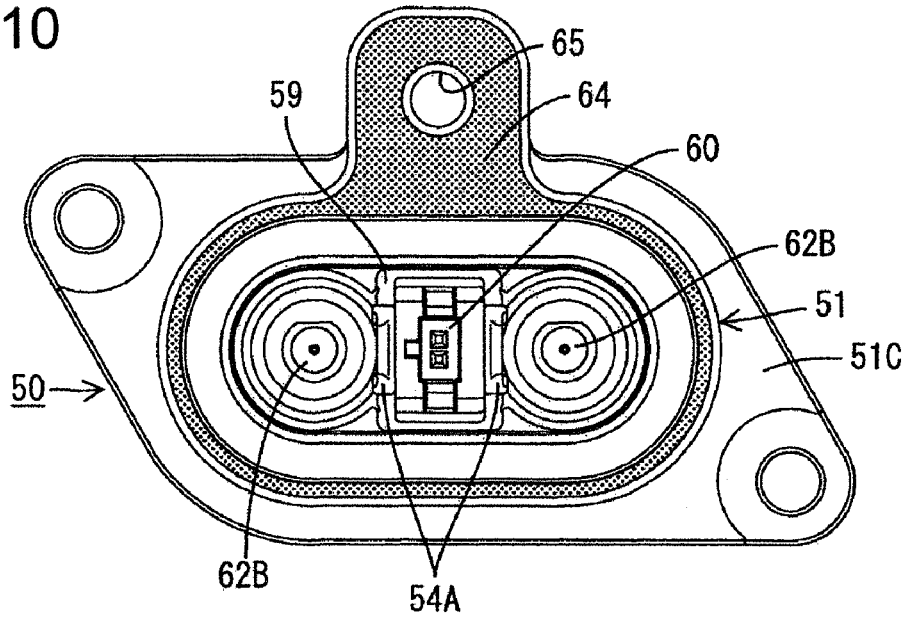
FIG. 10 is a front plan view showing the equipment-side shielding connector.

The electric wire-side shielding connector 20 is fit on the equipment-side shielding connector 50 in the state shown in FIGS. 1 and 4. More particularly, the electric wire-side housing 23 initially is inserted into the equipment-side shielding housing 51. At this time, the rib plate 54A of the equipment-side housing 54 starts to penetrate into the connector slit 23A of the electric wire-side housing 23.

The front tube 25A of the electric wire-side housing 23 and the electric wire-side box 26 start to penetrate into the corresponding equipment-side tube 58 of the equipment-side housing 54 and the equipment-side box 59 respectively as the operation of fitting the electric wire-side shielding connector 20 on the equipment-side shielding connector 50 progresses. At the same time, the front end of the fit-on bolt 39 mounted on the front hood 22 of the electric wire-side shielding housing 21 starts to penetrate into the connector fit-on nut 65 on the projection 53 of the equipment-side shielding housing 51.

The fit-on bolt 39 that has penetrated into the connector fit-on nut 65 is screwed into the connector fit-on nut 65. Thus, the electric wire-side shielding connector 20 is fit on the equipment-side shielding connector 50.

The equipment-side terminal fitting 62 penetrates through the open edge at the center of the front surface of the front tube 25A and moves into the electric wire-side housing 23 as the fit-on bolt 39 is screwed into the connector fit-on nut 65. The connection head 62B of the equipment-side terminal fitting 62 is locked to the connection part 33A of the electric wire-side terminal fitting 33 inside the front tube 25A. Thus, the projected terminal 62A of the equipment-side terminal fitting 62 contacts the inner wall surface of the electric wire-side terminal fitting 33 to connect the terminal fittings electrically. At this time, the fit-on detection terminal fitting 28 mounted in the locking detection terminal accommodation part 27 and the shorting terminal 60 mounted on the equipment-side housing 54 are connected to each other to form an electrically conductive state. The conductive state of the locking detection connector can be monitored to check whether the terminal fitting has reached the normal fit-on state.

Figure 11:
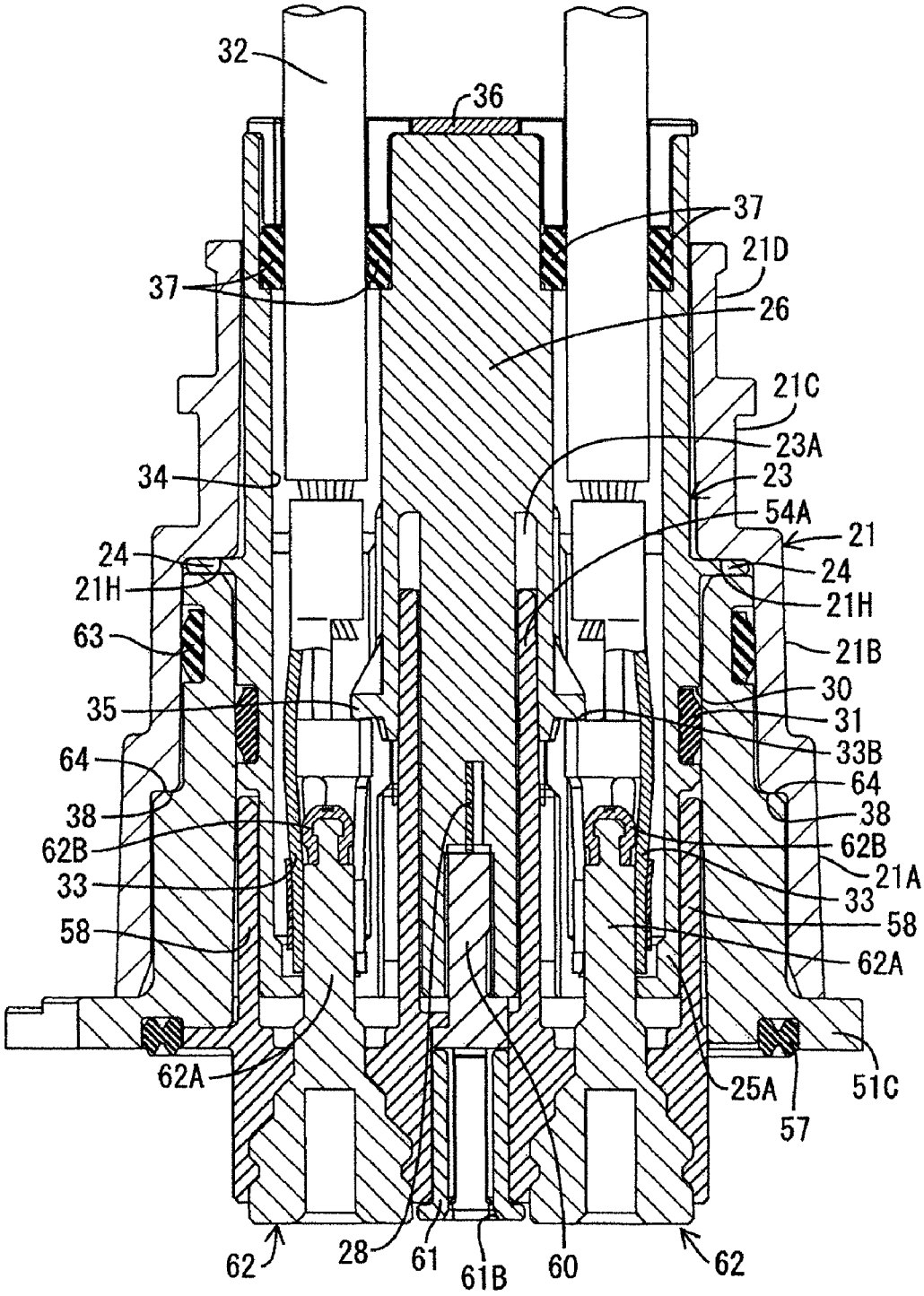
FIG. 11 is a sectional view corresponding to a state in which the male and female shielding connectors of FIG. 4 are fit together.
Figure 12:
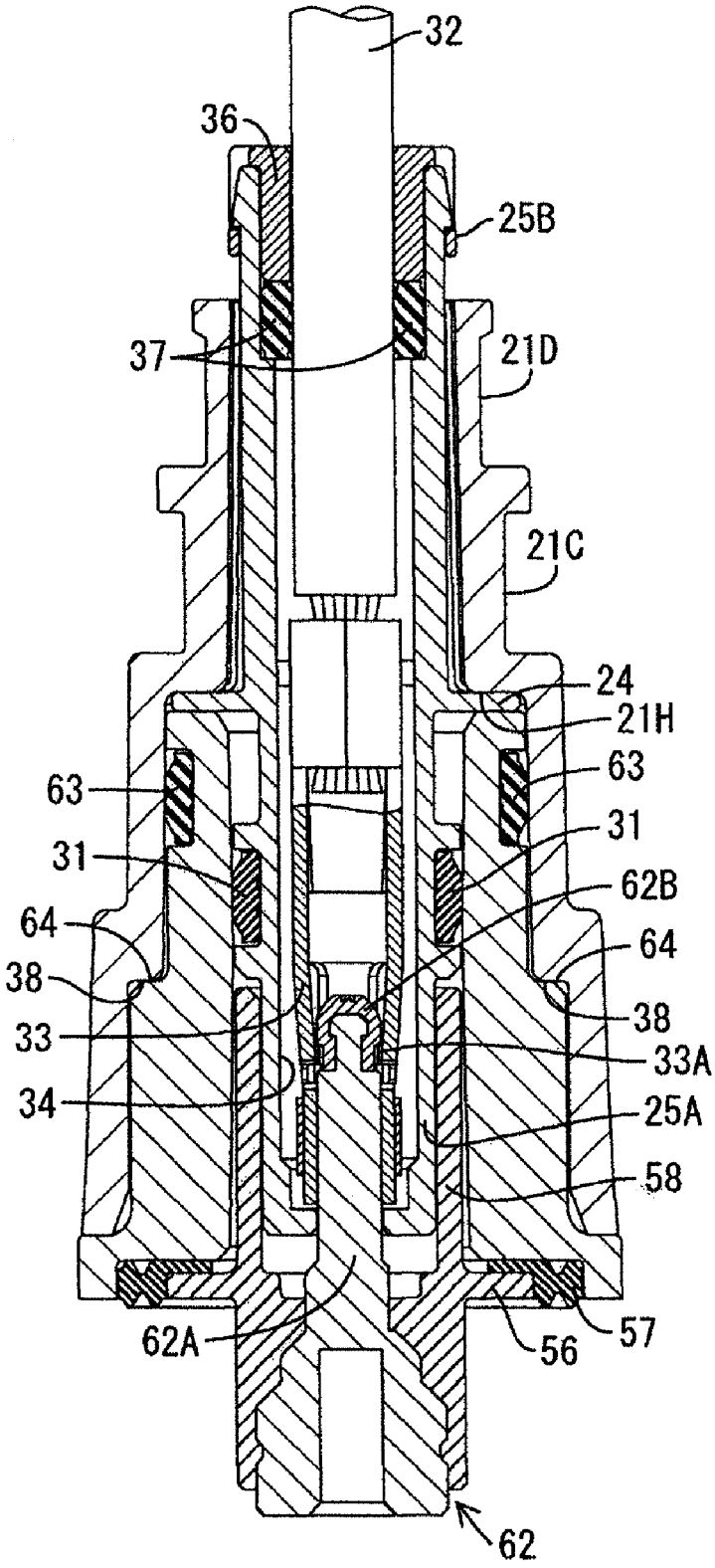
FIG. 12 is a sectional view corresponding to the state in which the male and female shielding connectors of FIG. 5 are fit together.
Figure 13:
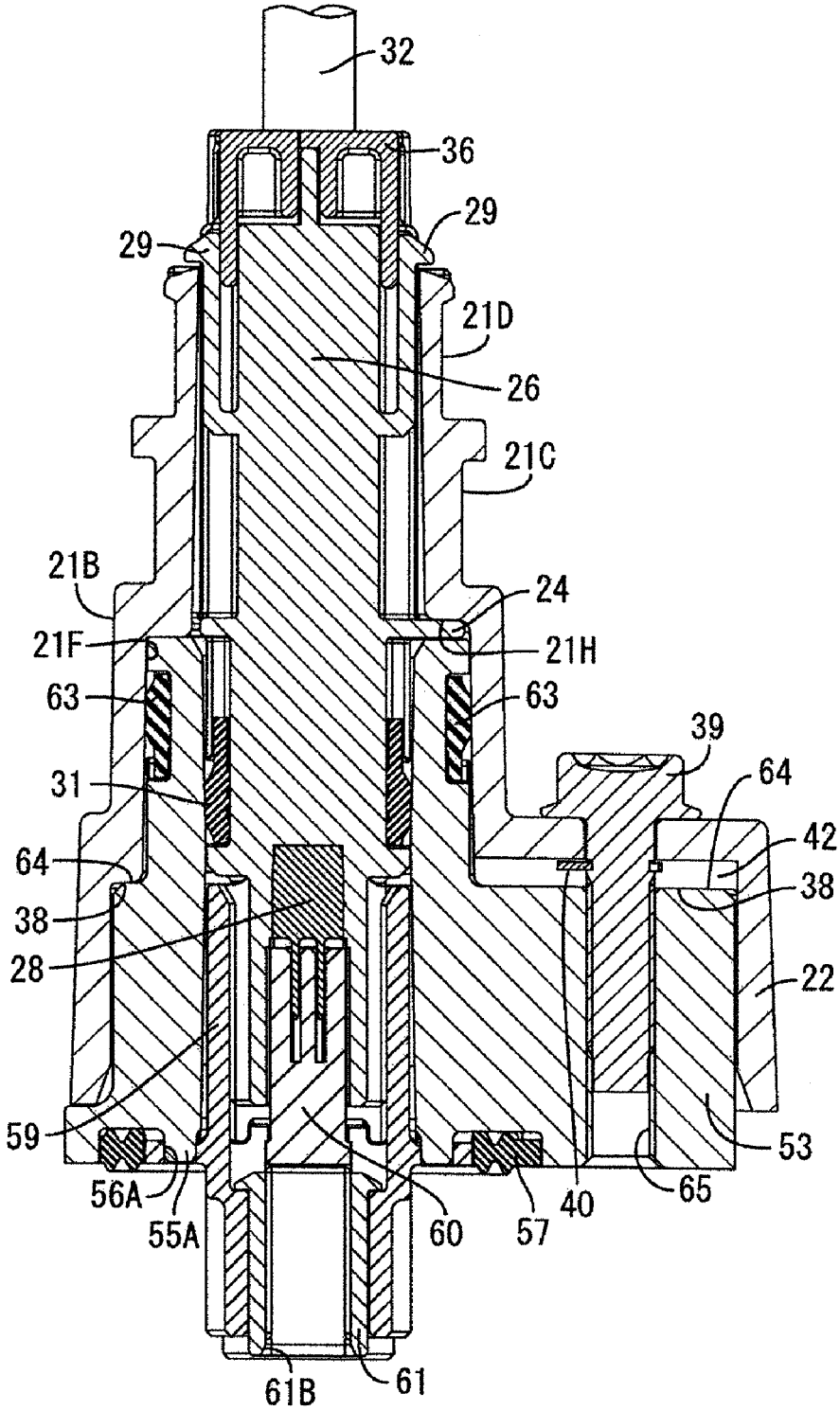
FIG. 13 is a sectional view corresponding to the state in which the male and female shielding connectors of FIG. 6 are fit together.

The electric wire-side contact surface 38 of the electric wire-side shielding housing 21 and the equipment-side contact surface 64 of the equipment-side shielding housing 51 contact each other when both shielding connectors have reached a normal fit-on state, as shown in FIGS. 11 through 13. Thus, the electric wire-side shielding housing 21 and the equipment-side shielding housing 51 are connected electrically to each other. In this manner, a loop-shaped shielding material is formed in the shielding connector in the region where the electric wire-side connector and the equipment-side connector are connected to each other.

The first rubber ring 31 mounted on the electric wire-side housing 23 is pressed against the inner surface of the equipment-side shielding housing 51 and the second rubber ring 63 mounted on the equipment-side shielding housing 51 is pressed against the electric wire-side inner peripheral wall 21F of the electric wire-side shielding housing 21 when the shielding connectors reach the normal fit-on state. Thus, double waterproof measures are taken for the region where the terminal fittings are disposed and to prevent water from penetrating into the electric wire-side housing 23 and the equipment-side housing 54.

As described above, the equipment-side shielding housing 51 is covered with the electric wire-side shielding housing 21 and then the fit-on bolt 39 is screwed into the connector fit-on nut 65 to fit the shielding connectors together. Thus, the connectors reach the normal fit-on state with the terminal fittings in the electric wire-side housing 23 connected to those inside the equipment-side housing 54. In addition, it is possible to construct the shielding connector in which the shielding material is formed by bringing the electric wire-side contact surface 38 and the equipment-side contact surface 64 into contact with each other and electrically connecting the electric wire-side shielding housing 21 and the equipment-side shielding housing 51 to each other. Thus, it is possible to greatly reduce the number of work steps and increase work efficiency.

The shielding connector of a second embodiment is illustrated in FIGS. 14 through 17 and has an effect and an operation similar to the first embodiment. However, the second embodiment also has a construction that enables an easy determination of whether the shielding connectors have been fit together properly.

Figure 14:
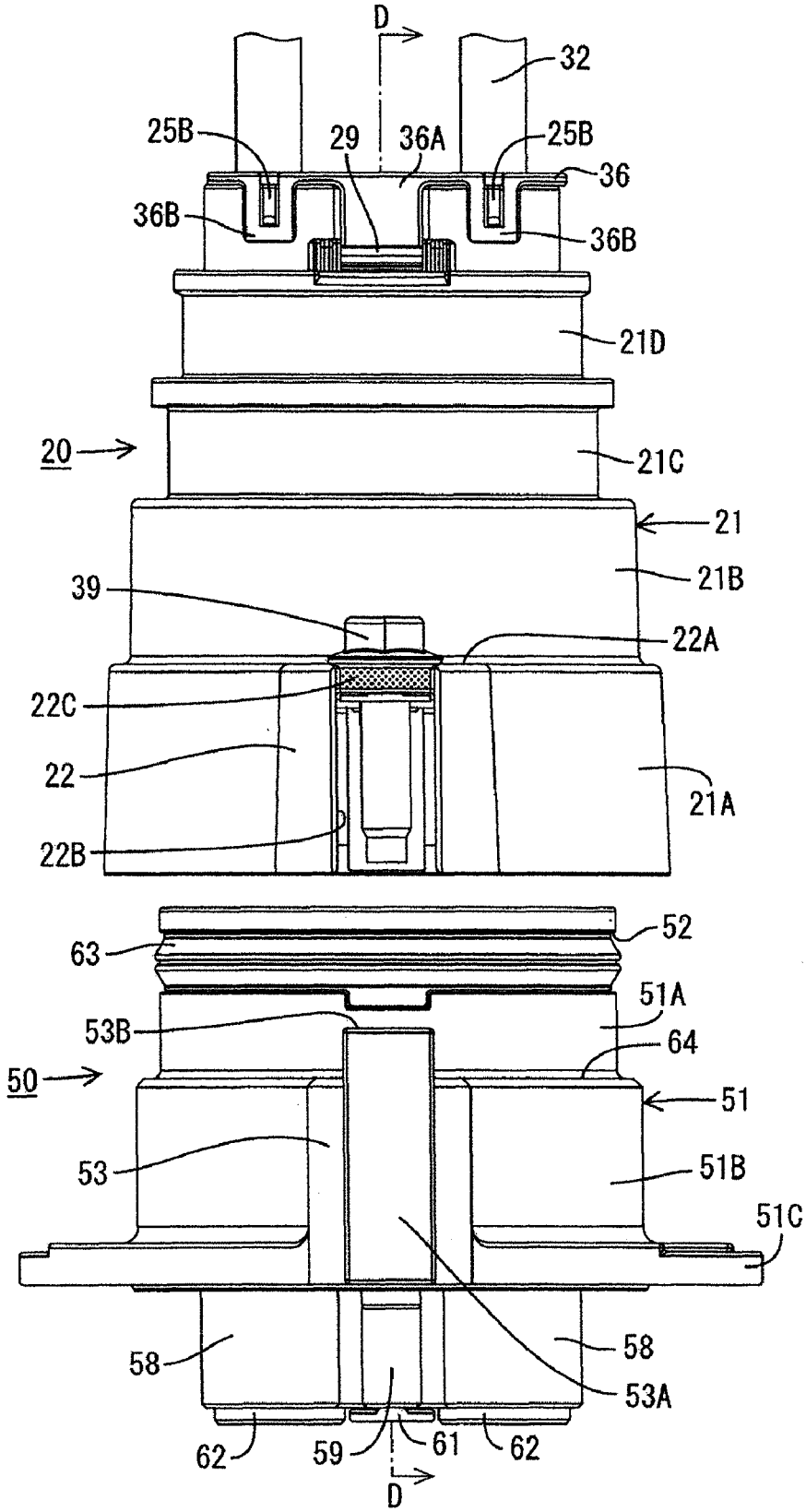
FIG. 14 is a front view showing a state before male and female shielding connectors of a second embodiment of the invention are fit together.
Figure 15:
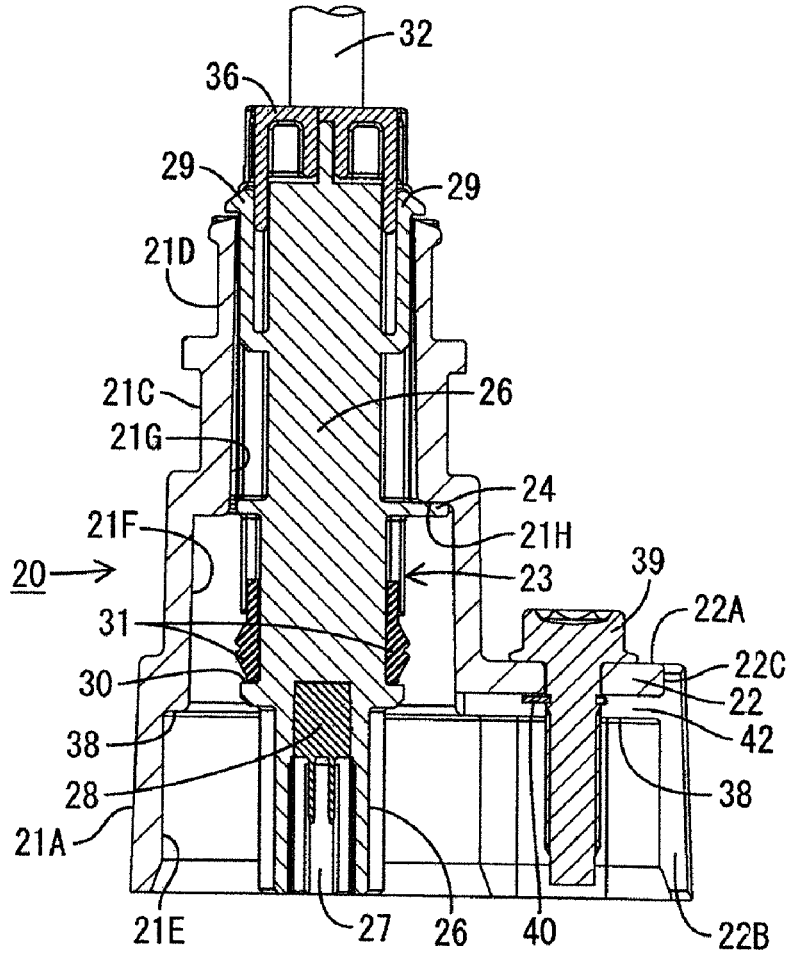
FIG. 15 is a sectional view taken along a line D-D of FIG. 14.
Figure 15:
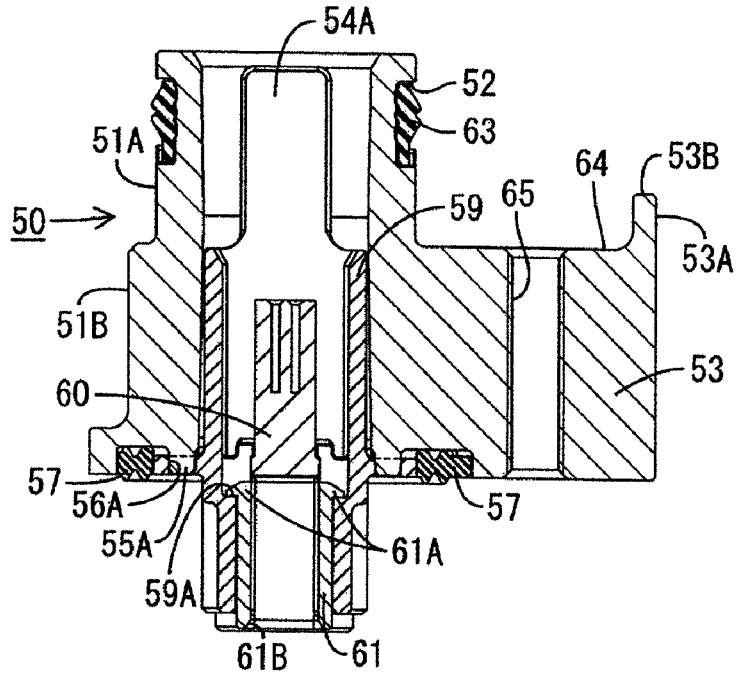
Figure 16:
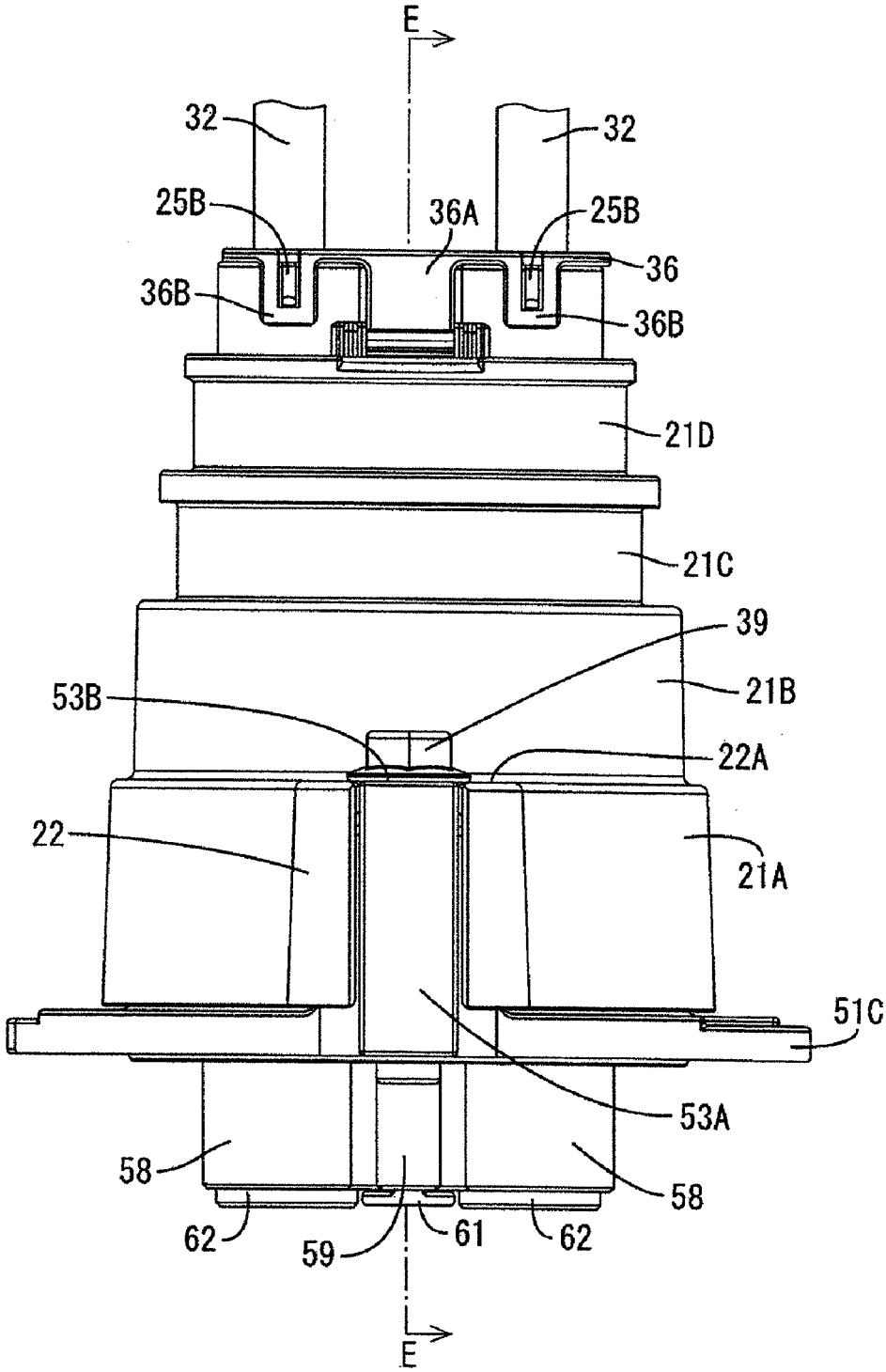
FIG. 16 is a front view showing a state after the male and female shielding connectors of the second embodiment are fit together.
Figure 17:
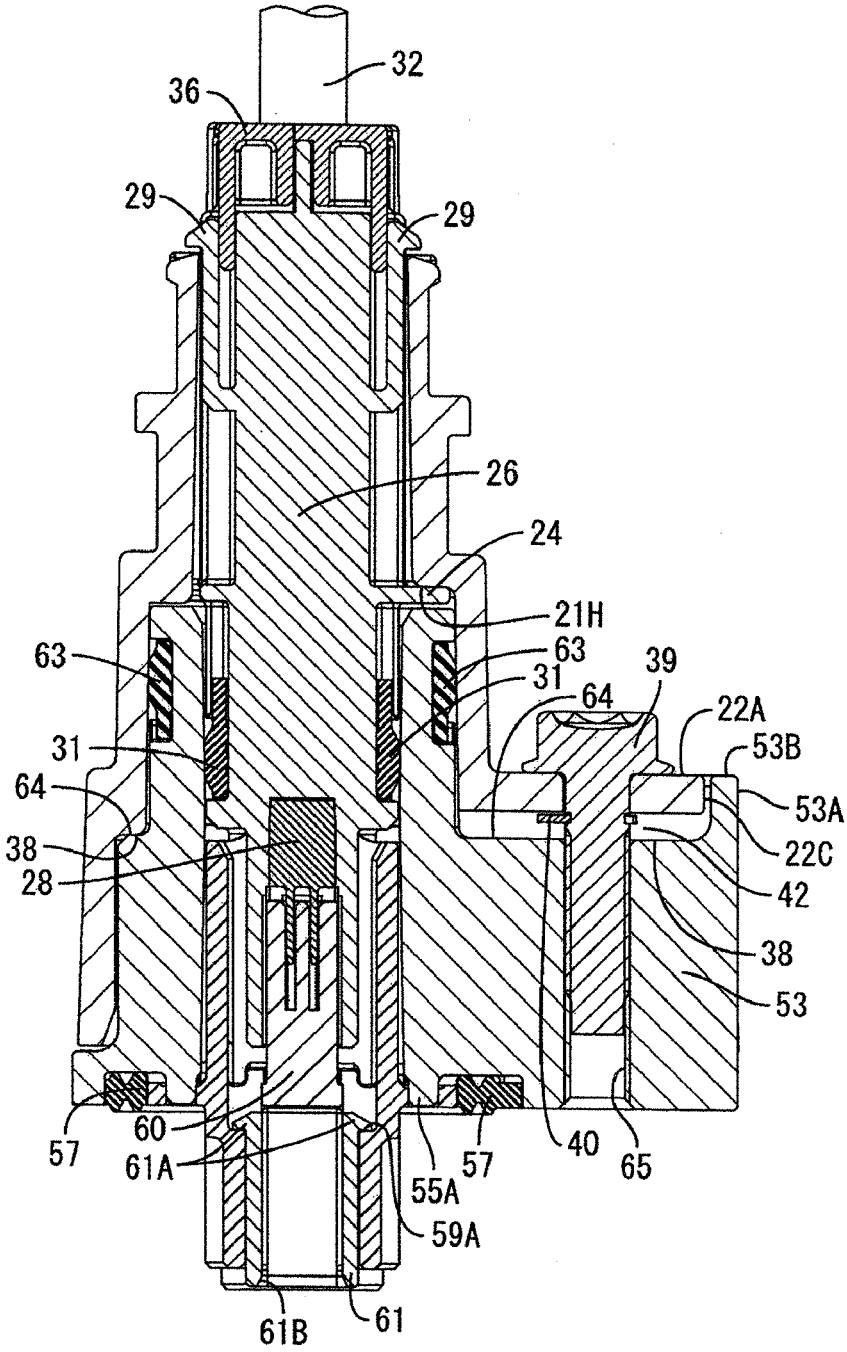
FIG. 17 is a sectional view taken along a line E-E of FIG. 16.
Figure 18:
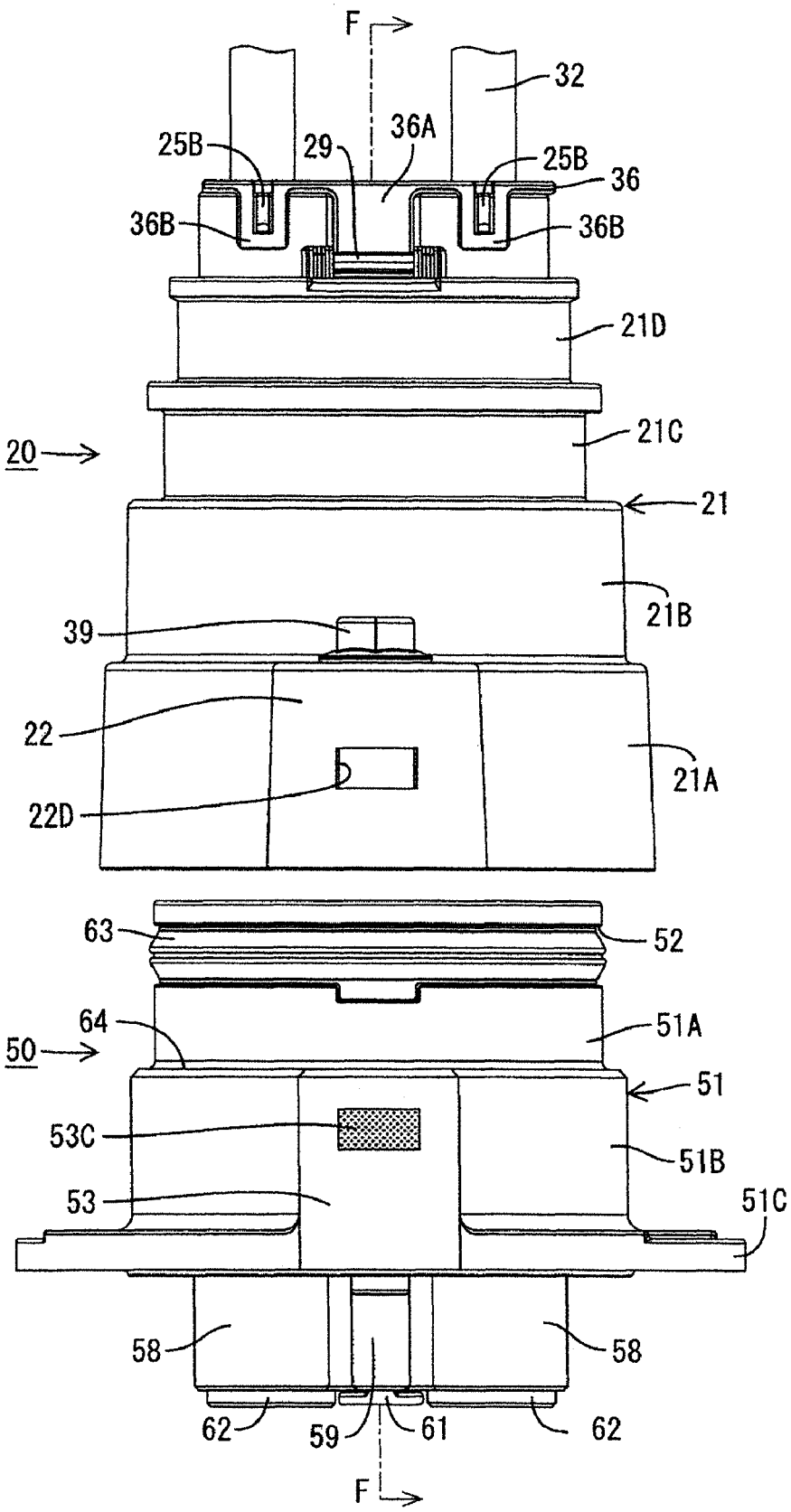
FIG. 18 is a front view showing a state before male and female shielding connectors of a third embodiment of the invention are fit together.
Figure 19:
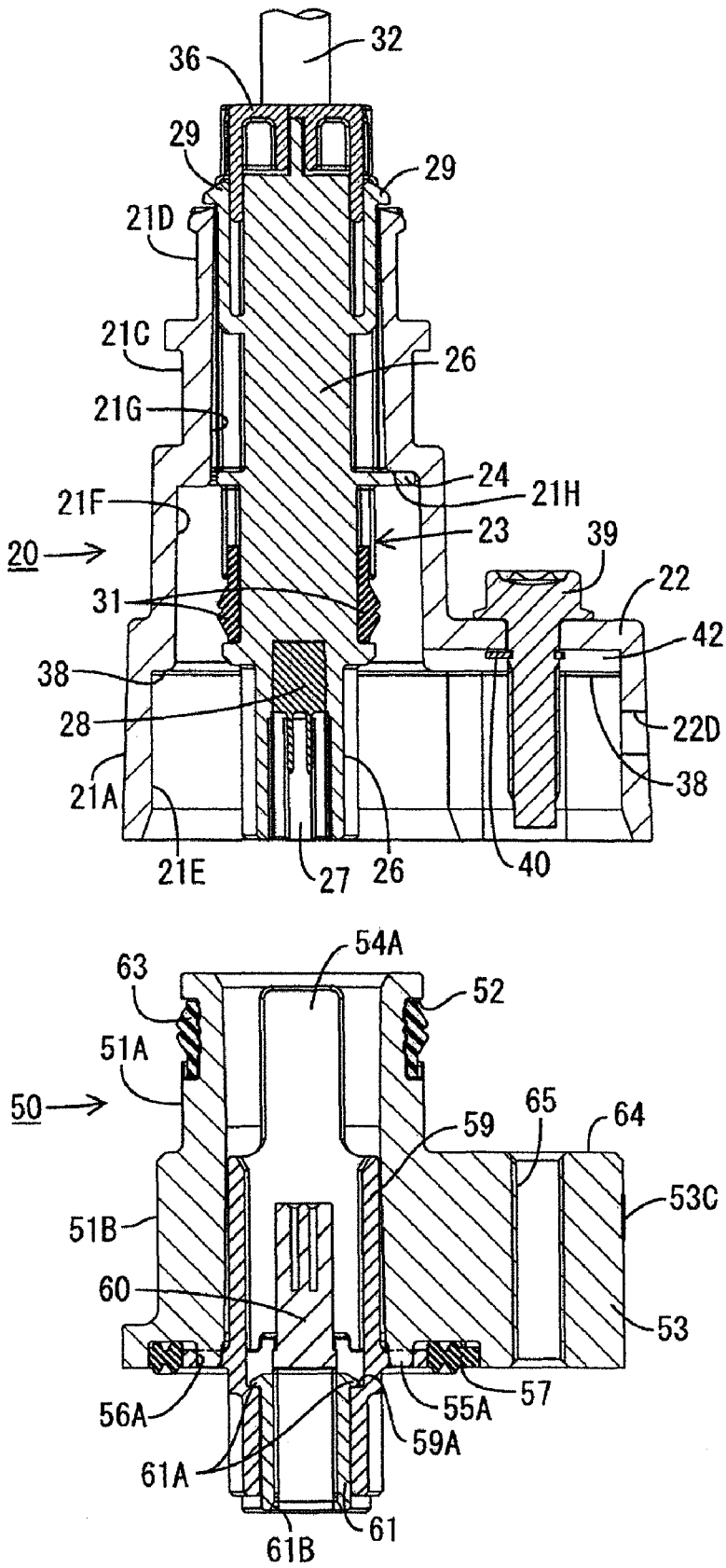
FIG. 19 is a sectional view taken along a line F-F of FIG. 18.
Figure 20:
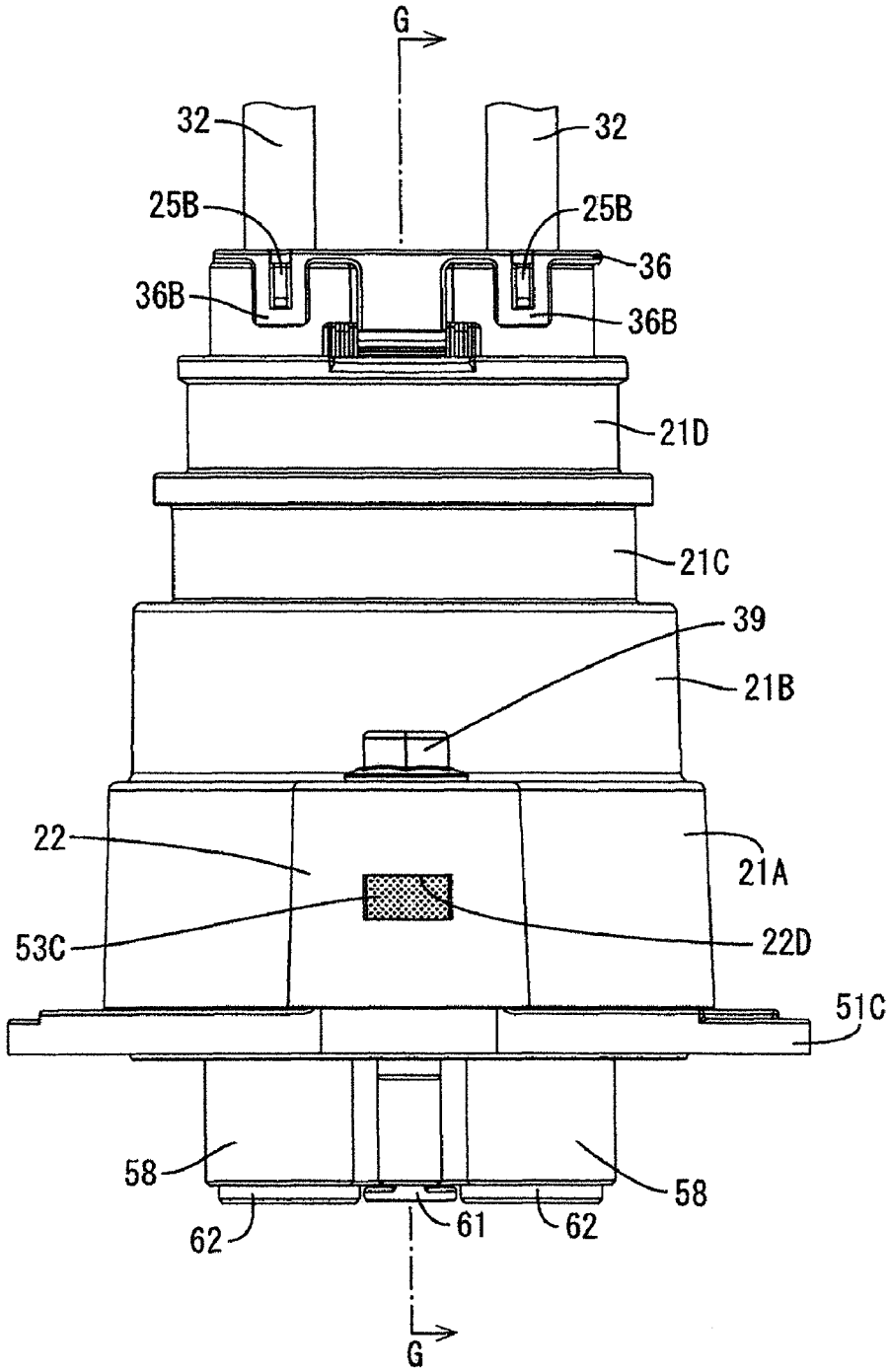
FIG. 20 is a front view showing a state after the male and female shielding connectors of the third embodiment are fit on each other.
Figure 21:
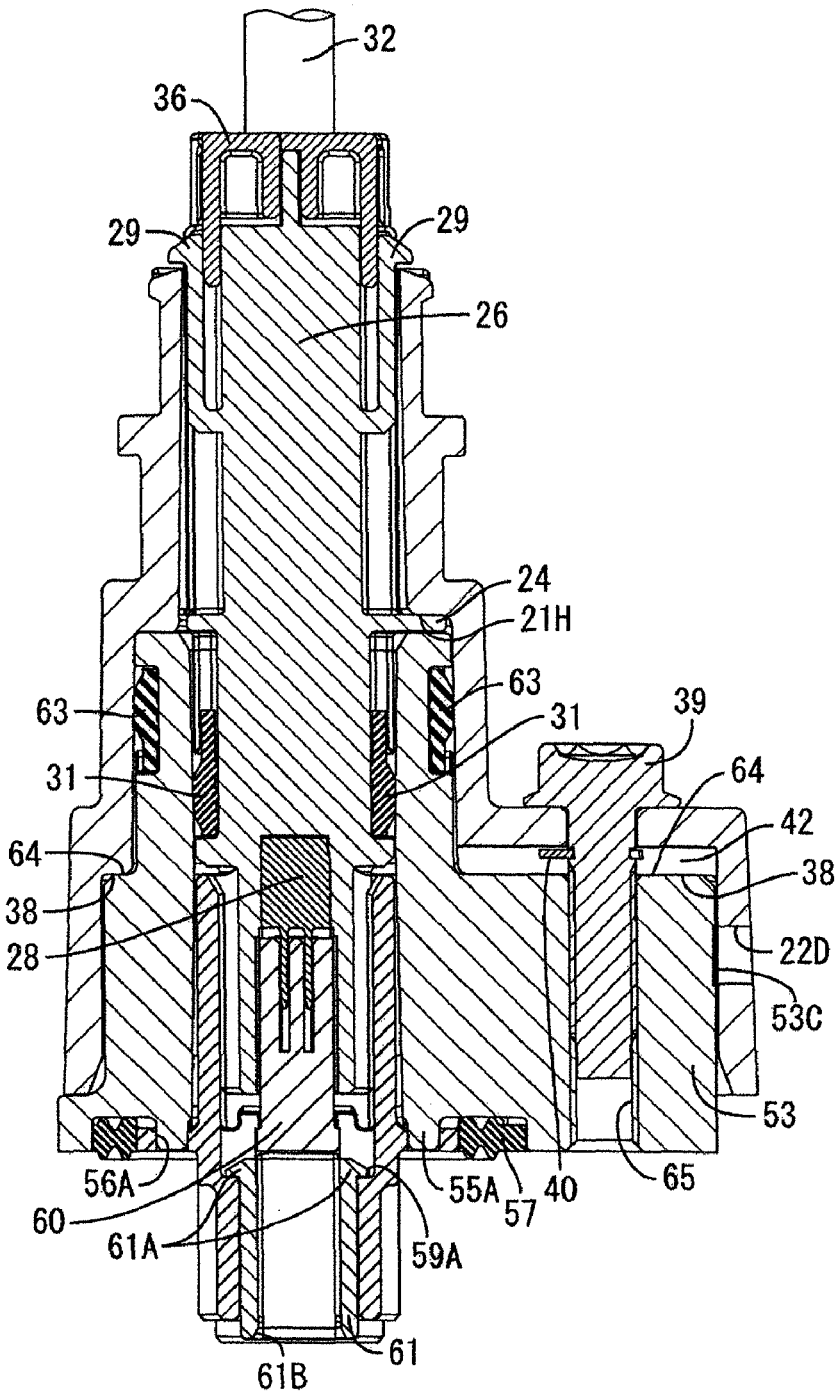
FIG. 21 is a sectional view taken along a line G-G of FIG. 20.

As shown in FIGS. 14 and 15, a slit 22B is formed on the front hood 22 of the electric wire-side shielding housing 21. A fit-on detection projection 53A corresponding to the slit 22B is formed on the projection 53 of the equipment-side shielding housing 51. The slit 22B is formed on a projected surface of the front hood 22 and extends straight in the fit-on direction from a front open edge of the front hood 22 to a rear end surface 22A thereof. The fit-on detection projection 53A is plate-shaped and extends straight from the rear end surface of the projection 53 to a position corresponding to the rear end of the front hood 22 disposed at the rear end of the slit 22B.

The fit-on detection projection 53A is accommodated in the slit 22B while fitting the shielding connectors together. A front end surface 53B of the fit-on detection projection 53A and a rear end surface of the front hood 22 are coincident and continuous with each other on the same plane when the shielding connectors reach a fit-on finish position. A colored part 22C is formed at an inner end of the slit 22B and has a color different from the front hood 22. The fit-on detection projection 53A hides the colored part 22C when the rear end surface 22A of the front hood 22 and the front surface 53B of the fit-on detection projection 53A are continuous with each other on the same plane.

The operation of fitting the shielding connectors of the second embodiment together is similar to that of the first embodiment. The fit-on detection projection 53A starts to penetrate the front end of the slit 22B soon after the electric wire-side housing 23 starts to penetrate into the equipment-side shielding housing 51 when fitting the electric wire-side shielding connector 20 on the equipment-side shielding connector 50.

The fit-on bolt 39 is screwed into the connector fit-on nut 65 so that the fit-on detection projection 53A is inserted gradually into the slit 22B. The rear end surface 22A of the front hood 22 and the front end surface 53B of the fit-on detection projection 53A are continuous with each other on the same plane when both shielding connectors reach the fit-on finish position. Additionally, the electric wire-side contact surface 38 of the electric wire-side shielding housing 21 and the equipment-side contact surface 64 of the equipment-side shielding housing 51 contact each other inside the electric wire-side shielding housing 21 (see FIGS. 16 and 17).

In the above-described constructions, an operator can check visually or by hand whether the end surface of the slit 22B and the front end surface 53B of the fit-on detection projection 53A are continuous to determine if the shielding connectors have reached the fit-on finish state.

The shielding connectors have reached the fit-on finish state when the rear end surface 22A of the front hood 22 and the front end surface 53B of the fit-on detection projection 53A are continuous with each other on the same plane. On the other hand, both shielding connectors have not reached the fit-on finish state if the rear end surface 22A of the front hood 22 and the front end surface 53B of the fit-on detection projection 53A are stepped. Therefore, it is possible to judge easily whether both shielding connectors have reached the fit-on finish state by checking the state of the two end surfaces.

The colored part 22C is formed at the inner end of the slit 22B. Thus, the colored part 22C is hidden by the fit-on detection projection 53A when the rear end surface 22A of the front hood 22 and the front end surface 53B of the fit-on detection projection 53A are continuous with each other on the same plane. Therefore by checking the of the two end surfaces, it is possible to easily determine whether both shielding connectors have reached the fit-on finish state (see FIGS. 16 and 17).

The shielding connector of the third embodiment is illustrated in FIGS. 18 through 21 and has an effect and an operation similar to the first embodiment. However, the third embodiment also has a construction that allows an easy determination of whether the shielding connectors have been fit together properly.

A fit-on detection opening 22D penetrates through the front hood 22 at a longitudinally central portion of the front hood 22 of the electric wire-side shielding housing 21. A marked portion 53C is formed on the projection 53 of the equipment-side shielding housing 51. The marked portion 53C with a size equal to that of the fit-on detection opening 22D is formed at a position corresponding to the fit-on detection opening 22D and has a color different from that of the front hood 22. When both shielding connectors have reached the fit-on finish state, the fit-on detection opening 22D and the marked portion 53C are coincident with each other. Thus, the entire marked portion 53C can be checked from the outside of the front hood 22.

The operation of fitting the shielding connectors together in the third embodiment is similar to that of the first embodiment. When the operation of fitting the shielding connectors together is being performed, the marked portion 53C formed by coloring the projection 53 gradually appears from the fit-on detection opening 22D formed on the front hood 22. When the shielding connectors have been fit together, the fit-on detection opening 22D and the marked portion 53C are coincident.

In the above-described construction, in bringing both shielding connectors into the fit-on finish state, whether the fit-on detection opening 22D and the marked portion 53C are coincident is checked. Thus, it is possible to easily determine whether both shielding connectors have reached the fit-on finish state (see FIGS. 20 and 21)

Figure 22:
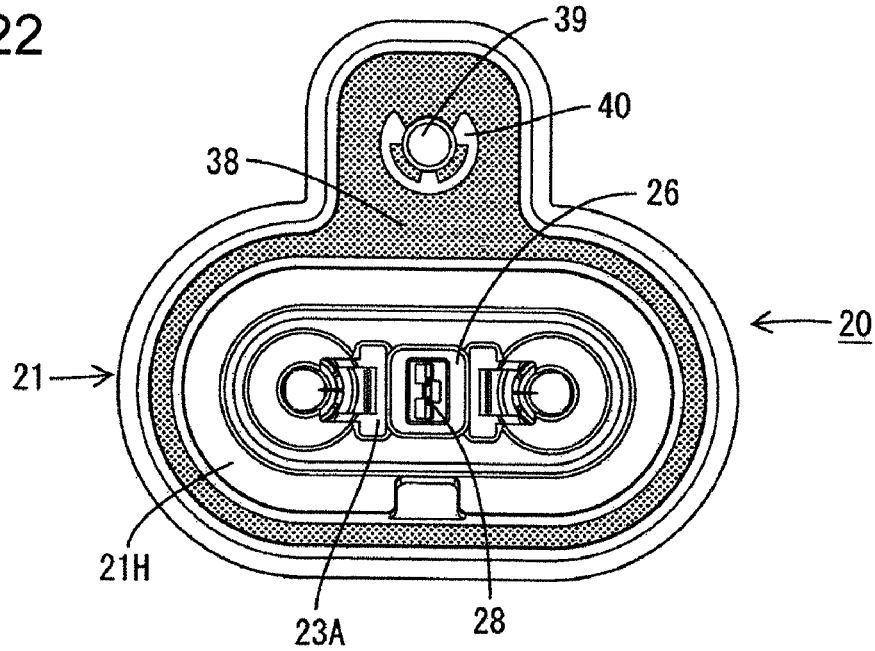
FIG. 22 is a front plan view of an electric wire-side shielding connector of a fourth embodiment.
Figure 23:
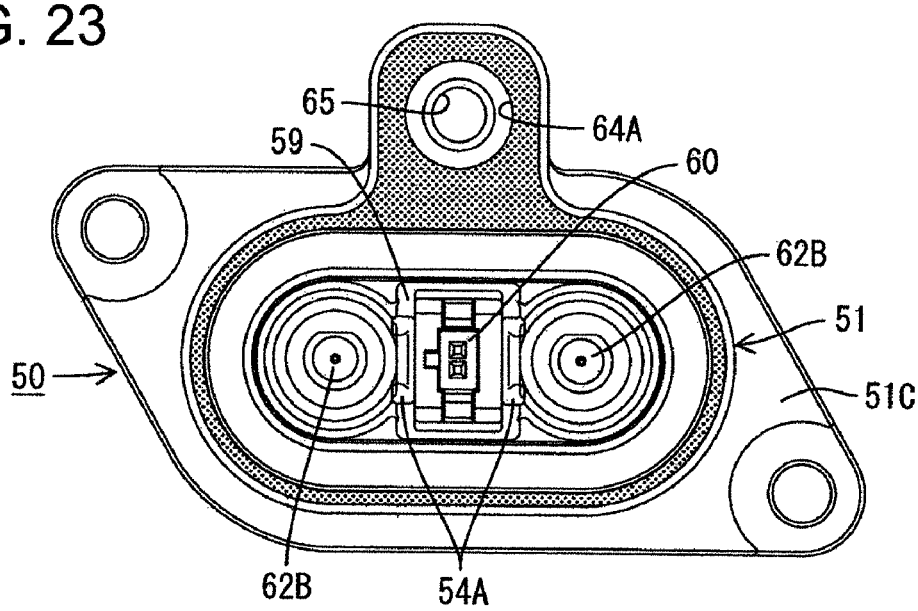
FIG. 23 is a front plan view of an equipment-side shielding connector of the fourth embodiment.

The shielding connector of the fourth embodiment is illustrated in FIGS. 22 and 23 and has an effect and an operation similar to those of the first embodiment. However, the third embodiment is different from the first embodiment in that the contact area between the electric wire-side contact surface 38 and the equipment-side contact surface 64 is larger. As shown in FIGS. 22 and 23, the construction of the electric wire-side contact surface 38 and the equipment-side contact surface 64 of the embodiment 4 is partly different from that of the electric wire-side contact surface 38 and the equipment-side contact surface 64 of the first embodiment.

The E-ring 40 holding the fit-on bolt 39 is mounted on the fit-on bolt 39 by being engaged by the fit-on bolt 39 at the electric wire-side contact surface 38. An accommodation concavity 64A a little deeper and a little larger than the E-ring 40 is formed on the equipment-side contact surface 64. When both shielding connectors have reached the fit-on finish state, the E-ring 40 is accommodated in the accommodation concavity 64A.

The operation of fitting the shielding connectors on each other to be performed in the embodiment 4 is similar to that to be performed in the embodiment 1. When both shielding connectors have reached the fit-on finish state, the E-ring 40 is accommodated in the accommodation concavity 64A, as described above.

The E-ring 40 is accommodated in the accommodation concavity 64A when both shielding connectors have reached the fit-on finish state. Thus, the area of a contact between the electric wire-side contact surface 38 and the equipment-side contact surface 64 are large and loop-shaped to increase the shielding effect.

The invention is not limited to the embodiments described above with reference to the drawings. For example, the following embodiments are also included in the technical scope of the present invention.

The fit-on bolt 39 is combined with the front-end hood part 22 in advance in the embodiments. But the present invention may be so constructed that after the equipment-side shielding housing 51 is inserted into the electric wire-side shielding housing 21, the fit-on bolt 39 is mounted on the front hood 22.

The equipment-side contact surface 64 is formed on the outer wall of the equipment-side shielding housing 51 in the embodiments. But the invention is not limited to this form. In the present invention, the equipment-side contact surface 64 may be formed on the front end surface of the equipment-side shielding housing 51.

In the second embodiment, the slit 22B is formed on the front hood 22, and the fit-on detection projection 53A is formed on the projection 53. However, the slit 22B may be formed on the outer wall of the electric wire-side shielding housing 21, and the fit-on detection projection 53A may be formed on the outer wall of the equipment-side shielding housing 51. Needless to say, the slit and the fit-on detection projection are fit together.

In the second and third embodiments, the color of the colored part 22C and that of the marked portion 53C are different from that of the front hood 22. However, a distinguishing mark may be used at these locations instead of a different color.

What is claimed is:

1. A shielding connector apparatus comprising:

an equipment-side connector having opposite front and rear ends spaced apart along a fit-on direction, the equipment-side connector having an equipment-side shielding housing, a connector fit-on nut mounted on the equipment-side shielding housing and an equipment-side contact surface defining a substantially loop-shape extending entirely around a periphery of the equipment-side shielding housing and being electrically continuous therewith, the equipment-side contact surface intersecting the fit-on direction; and an electric wire-side connector with a shielding housing, a fit-on bolt provided on said shielding housing of said electric wire-side connector and being screwed into said connector fit-on nut to fit said electric wire-side connector on said equipment-side connector, an electric wire-side contact surface provided on said shielding housing of said electric wire-side connector defining a substantially loop-shape extending entirely around a periphery of the electric wire-side connector, said electric wire-side contact surface being brought electrically into contact with said equipment-side contact surface when the connectors have reached a fit-on finish position by screwing said fit-on bolt into said connector fit-on nut.

2. The shielding connector apparatus of claim 1, further comprising a removal prevention ring provided on a surface of said shielding housing of said electric wire-side connector at a fit-on side thereof, the removal prevention ring preventing said fit-on bolt from being removed from the shielding housing of the shielding housing, said electric wire-side contact surface projecting farther than the removal prevention ring in the fit-on direction.

3. The shielding connector apparatus of claim 2, wherein the equipment-side contact surface has an accommodation concavity, the removal prevention ring being accommodated in the accommodation concavity when the connectors have reached a fit-on finish position by screwing said fit-on bolt into said connector fit-on nut.

4. The shielding connector apparatus of claim 1, wherein said equipment-side connector and said electric wire-side connector are provided with locking detection connectors; said locking detection connectors being fit together when the connectors have reached the fit-on finish position, one of the locking detection connectors having two fit-on detection terminal fittings, and the other of said locking detection connectors has a shorting terminal the short-circuits said fit-on detection terminal fittings.

5. The shielding connector apparatus of claim 1, wherein said shielding housing of said electric wire-side connector has a body covering said electric wire-side connector and a front hood forward of said body in said fit-on direction the connectors, the front hood defining a stepped increase in a width of the shielding housing of said electric wire-side connector, a slit being formed at a front-end edge of the front hood and extending in the fit-on direction of the connectors, a fit-on detection projection projecting from the equipment-side shielding housing and penetrating into said slit with a progress of fit-on of the connectors, and a height of the fit-on detection projection being set so that when the housings have reached said fit-on finish position, a front end of said fit-on detection projection is coincident with an outer surface of a step at a boundary between said front-end hood and said body.

6. The shielding connector apparatus of claim 5, wherein a colored part having a color different from that of said front hood is formed at an inner end of said slit, the colored part being hidden by said front end of said fit-on detection projection when the connectors have reached said fit-on finish position.

7. The shielding connector apparatus of claim 1, wherein a fit-on detection opening is formed at a predetermined position of said shielding housing of said electric wire-side connector, and a marked portion is formed on said equipment-side shielding housing and being visible when the connectors have reached the fit-on finish position.

* * * * *